US012480303B2

(12) United States Patent
Jiang

(10) Patent No.: US 12,480,303 B2
(45) Date of Patent: Nov. 25, 2025

(54) STORAGE SHED STRUCTURE

(71) Applicant: Three Stone, LLC, San Jose, CA (US)

(72) Inventor: Jinglei Jiang, Yuyao (CN)

(73) Assignee: Three Stone, LLC, San Jose, CA (US)

( * ) Notice: Subject to any disclaimer, the term of this patent is extended or adjusted under 35 U.S.C. 154(b) by 351 days.

(21) Appl. No.: 18/362,818

(22) Filed: Jul. 31, 2023

(65) Prior Publication Data

US 2024/0035271 A1 Feb. 1, 2024

Related U.S. Application Data

(60) Provisional application No. 63/369,970, filed on Jul. 31, 2022.

(51) Int. Cl.
*E04B 1/343* (2006.01)
*E04B 1/61* (2006.01)

(52) U.S. Cl.
CPC ..... *E04B 1/34321* (2013.01); *E04B 1/34317* (2023.08); *E04B 1/34384* (2013.01); *E04B 1/6116* (2013.01); *E04B 1/6137* (2013.01); *E04B 1/6162* (2013.01); *E04B 2001/6195* (2013.01); *E04B 2103/04* (2013.01)

(58) Field of Classification Search
CPC ..... E04B 1/34321; E04B 1/34317; E04B 1/34384; E04B 1/6116; E04B 1/6137; E04B 1/6162; E04B 2001/6195; E04B 2103/04; E04B 1/12; E04B 1/6141; E04H 1/1205
See application file for complete search history.

(56) References Cited

U.S. PATENT DOCUMENTS

| | | | | |
|---|---|---|---|---|
| 5,357,728 | A * | 10/1994 | Duncanson | E04C 2/526 52/592.4 |
| 7,377,077 | B2 * | 5/2008 | Rebeck | E04H 1/1205 52/DIG. 14 |
| 8,707,631 | B2 * | 4/2014 | Scouten | E04H 9/14 52/68 |
| 10,697,171 | B2 * | 6/2020 | Melo Pereira | E04C 2/384 |
| 11,020,681 | B2 * | 6/2021 | Rieber | F16C 11/04 |
| 11,135,525 | B2 * | 10/2021 | Rieber | E04B 1/3445 |
| 11,274,431 | B2 * | 3/2022 | McCall | E04F 13/0871 |
| 11,927,008 | B2 * | 3/2024 | Giacomini | E04B 1/345 |
| 12,116,773 | B2 * | 10/2024 | Keller | E04C 2/46 |
| 12,291,859 | B2 * | 5/2025 | Keller | E04B 5/02 |
| 2003/0005660 | A1 * | 1/2003 | Stibolt | E04F 13/06 52/582.1 |
| 2005/0126083 | A1 * | 6/2005 | Rebeck | E04H 1/1205 52/79.1 |
| 2008/0216426 | A1 * | 9/2008 | Bunker | E04B 1/34315 52/285.3 |

(Continued)

*Primary Examiner* — Rodney Mintz
(74) *Attorney, Agent, or Firm* — Platinum Intellectual Property

(57) ABSTRACT

The present subject matter discloses an outdoor storage shed utilizing plastic components or panels. A storage shed structure can comprise foldable corner panels, which pivot at integrated folding grooves to serve as corners. Each leaf of a foldable corner panel can be fitted with a unique coupling mechanism to interact with an additional panel. Furthermore, the storage shed structure can come with pre-constructed shelf grooves in the foldable corner panels. Storage shelves can be slotted into these grooves, thereby boosting the overall stability of the storage shed.

19 Claims, 38 Drawing Sheets

(56) References Cited

U.S. PATENT DOCUMENTS

| | | | | |
|---|---|---|---|---|
| 2012/0180404 | A1* | 7/2012 | Scouten | E04H 9/028 52/79.5 |
| 2016/0138258 | A1* | 5/2016 | Schaffert | E04B 1/3445 52/79.5 |
| 2017/0051497 | A1* | 2/2017 | Kolbe | E04H 1/1205 |
| 2019/0055728 | A1* | 2/2019 | Melo Pereira | E04C 2/22 |
| 2019/0136506 | A1* | 5/2019 | McCall | E04C 2/365 |
| 2020/0049462 | A1* | 2/2020 | Jones | E04H 1/1205 |
| 2020/0215448 | A1* | 7/2020 | Rieber | A63H 33/008 |
| 2020/0215449 | A1* | 7/2020 | Rieber | E04B 1/345 |
| 2022/0127840 | A1* | 4/2022 | Giacomini | E04B 1/34384 |
| 2022/0298783 | A1* | 9/2022 | Shi | E04B 1/3445 |
| 2023/0061113 | A1* | 3/2023 | Keller | E04B 2/56 |
| 2023/0068992 | A1* | 3/2023 | Streeter | E04H 1/005 |
| 2023/0167636 | A1* | 6/2023 | Keller | E04B 1/14 52/91.3 |
| 2024/0035272 | A1* | 2/2024 | Jiang | E04B 1/6141 |
| 2025/0027314 | A1* | 1/2025 | Iin | E04H 1/1205 |
| 2025/0034891 | A1* | 1/2025 | Jiang | E04H 1/1205 |
| 2025/0163695 | A1* | 5/2025 | Rais-Rohani | E04B 1/3445 |

* cited by examiner

STORAGE SHED STRUCTURE

CROSS-REFERENCES TO RELATED APPLICATIONS

This application claims the priority of Provisional Application No. 63/369,970, entitled "OUTDOOR STORAGE SHED," filed Jul. 31, 2022, which is incorporated herein by reference for all purposes.

TECHNICAL FIELD

The present subject matter is in the field of plastic assembly. More particularly, embodiments of the present subject matter relate to a storage shed comprising molded plastic panels.

BACKGROUND

Molded plastic has a wide variety of benefits as a furniture material and component. For example, it is highly resistant to impact, moisture, and chemicals, which makes it more durable compared to other materials like wood or glass; it is also lighter than many other materials, rendering it advantageous for transportation cost. Furthermore, molded plastics can be shaped into virtually any form, allowing for a great deal of design flexibility. This allows for more creative and complex designs than other materials. An example of such a design is an outdoor storage shed that is economical to manufacture, easy to transport and install while providing many novel and beneficial design features.

SUMMARY OF THE INVENTION

The present subject matter is directed to improved designs for an outdoor storage shed utilizing molded plastic components or panels. Embodiments of the present subject matter are discussed below with reference to FIGS. 1-39.

In the following description, for purposes of explanation, numerous specific details are set forth in order to provide a thorough understanding of the present subject matter. It will be apparent, however, to one skilled in the art that the present subject matter may be practiced without some of these specific details. In addition, the following description provides examples, and the accompanying drawings show various examples for the purposes of illustration. Moreover, these examples should not be construed in a limiting sense as they are merely intended to provide examples of embodiments of the subject matter rather than to provide an exhaustive list of all possible implementations. In other instances, well-known structures and devices are shown in block diagram form in order to avoid obscuring the details of the disclosed features of various described embodiments.

According to some embodiments, the present subject matter is directed to a storage shed structure made of molded plastic panels, the shed structure comprises: a floor further comprises a plurality of corner edge floor panels, and a plurality of transitional floor panels coupled to the plurality of corner edge floor panels via one or more connectors. It further has side walls coupled with the floor, the side walls further comprise a plurality of flat panels, a plurality of foldable corner panels that form four corners of the storage shed structure. The storage shed structure further comprises one or more doors coupled with the side walls and the floor, and a roof that comprises a plurality of foldable roof panels. According to some embodiments, the shed further comprises a lintel installed between the roof and the side walls, wherein the lintel comprises one or foldable lintel panels.

According to some embodiments, each of the molded plastic panels has similar size and shape to reduce package space and transportation cost. Also, the one or more connectors comprise at least a butterfly connector and a cross/double-butterfly connector.

According to some embodiments, each foldable corner panel has an integrated folding groove that has thinner plastic material, and wherein the embedded folding groove enables each foldable corner panel to fold at a fixed angle when the storage shed structure is installed. The embedded folding groove can enable each corner edge floor panel and each foldable corner panel to lay flat during transportation.

According to some embodiments, the molded plastic panels comprise a number of back strengthening ribs that comprise vertical support grooves and horizontal support grooves, and wherein each vertical support groove is surrounded by a plurality of horizontal support grooves.

According to some embodiments, each corner edge floor panel has two sides to connect to wall panels and each transitional floor panel has one side to connect to the wall panels.

According to some embodiments, at least one side of the corner edge floor has more than one coupling mechanism. According to some embodiments, a first side of a transitional floor panel has a first slider rail, a first side of a corner edge floor panel has a second slider rail configured to be in continuation with the first slider rail, and wherein the first side of the corner edge floor panel further has one or more clips. According to some embodiments, the first slider rail comprises one of a L-shaped groove and a T-shaped groove, or another type of groove.

According to some embodiments, the first slider rail of the transitional floor panel and the second slider rail of the corner edge floor panel are configured to engage with a first slider of a wall panel, and wherein the one or more clips of the corner edge floor panel are configured to engage one or more clip slots on the wall panel.

According to some embodiments, the plurality of foldable corner panels are connected to the plurality of flat panels via interlocked teeth couplings. The interlocked teeth couplings comprise a plurality of protrusions and matched recesses arranged on both the plurality of foldable corner panels and the plurality of flat panels, wherein the plastic material has varied depth based on the design of the interlocked teeth couplings.

According to some embodiments, the plurality of transitional floor panels and the plurality of flat panels of the side walls are extendable. According to some embodiments, a concave door frame can transition within a foldable corner panel, wherein the concave door frame is sloped towards a door.

According to some embodiments, a plurality of supporting beams can be stored within embedded lots in the back of the molded plastic panels during transportation, wherein a depth of the embedded slots is smaller than a depth of the supporting beams.

According to some embodiments, the interior surface of foldable corner panels can have a plurality of embedded shelf grooves. One or more shelves can be slotted into the shelf grooves to provide storage and to enhance the stability of the storage shed structure.

According to some embodiments, the present subject matter is directed to a foldable molded plastic panel that comprises an embedded folding groove that divides a molded plastic panel into a first leaf and a second leaf, wherein the embedded folding groove has thinner plastic material that enables the molded plastic panel to fold at a fixed angle when the foldable molded plastic panel is installed, wherein the foldable molded plastic model unfolds and forms a flat surface prior to the installation, and wherein the foldable molded plastic model functions as a corner for a molded plastic structure after the installation.

According to some embodiments, the foldable molded plastic panel further comprises a second embedded folding groove with thinner less plastic material.

According to some embodiments, the foldable molded plastic panel further comprises a first coupling structure arranged on a first leaf, and a second coupling structure arranged on a second leaf, wherein the first coupling structure is different from the second coupling structure. Furthermore, the first coupling structure can comprise a slider and the second coupling structure comprises one or more clip slots.

According to some embodiments, the foldable molded plastic panel further comprises a plurality of shelf grooves embedded into interior surfaces of the foldable molded plastic panel. According to some embodiments, one or more shelves can be slotted into the plurality of shelf grooves to provide storage and to enhance the stability of the storage shed structure.

According to some embodiments, the foldable molded plastic panel further comprises a number of back strengthening ribs that comprise vertical support grooves and horizontal support grooves, and wherein each vertical support groove is surrounded by a plurality of horizontal support grooves.

According to some embodiments, the foldable molded plastic panel further comprises a first plurality of interlocked teeth couplings arranged at a first edge of the foldable molded plastic panel, wherein the first plurality of interlocked teeth couplings are configured to engage a second plurality of interlocked teeth couplings of another molded plastic panel. Furthermore, the first plurality of interlocked teeth couplings and the second plurality of interlocked teeth couplings can be further secured by an additional fixing mechanism.

According to some embodiments, the present subject matter is directed to a storage shed structure made of molded plastic panels. It comprises a floor further that further comprises a plurality of corner edge floor panels, and a plurality of transitional floor panels coupled to the plurality of corner edge floor panels via one or more connectors. The shed structure further comprises side walls coupled with the floor, the side walls further comprise a plurality of flat panels, a plurality of foldable corner panels that form four corners of the storage shed structure, a plurality of shelf grooves embedded into the interior surface of corner panels, and one or more shelves configured to insert into the plurality of shelf grooves to provide storage and to enhance the stability of the storage shed structure. Furthermore, the storage shed structure can consist of one or more doors coupled with the side walls and the floor, and a roof that comprises a plurality of foldable roof panels.

Other aspects and advantages of the present subject matter will become apparent from the following detailed description taken in conjunction with the accompanying drawings, which illustrate, by way of example, the principles of the present subject matter.

DESCRIPTION OF DRAWINGS

The present subject matter will be further described in detail below with reference to the embodiments of the accompanying drawings.

DETAILED DESCRIPTION

It is to be understood that even though numerous characteristics and advantages of various embodiments of the present subject matter have been set forth in the foregoing description, together with details of the structure and function of various embodiments of the subject matter, this disclosure is illustrative only. In some cases, certain subassemblies are only described in detail with one such embodiment. Nevertheless, it is recognized and intended that such subassemblies may be used in other embodiments of the subject matter. Practitioners skilled in the art will recognize many modifications and variations. Changes may be made in detail, especially matters of structure and management of parts within the principles of the embodiments of the present subject matter to the full extent indicated by the broad general meaning of the terms in which the appended claims are expressed.

Having disclosed exemplary embodiments and the best mode, modifications and variations may be made to the disclosed embodiments while remaining within the scope of the embodiments of the subject matter as defined by the following claims.

Figure 1:
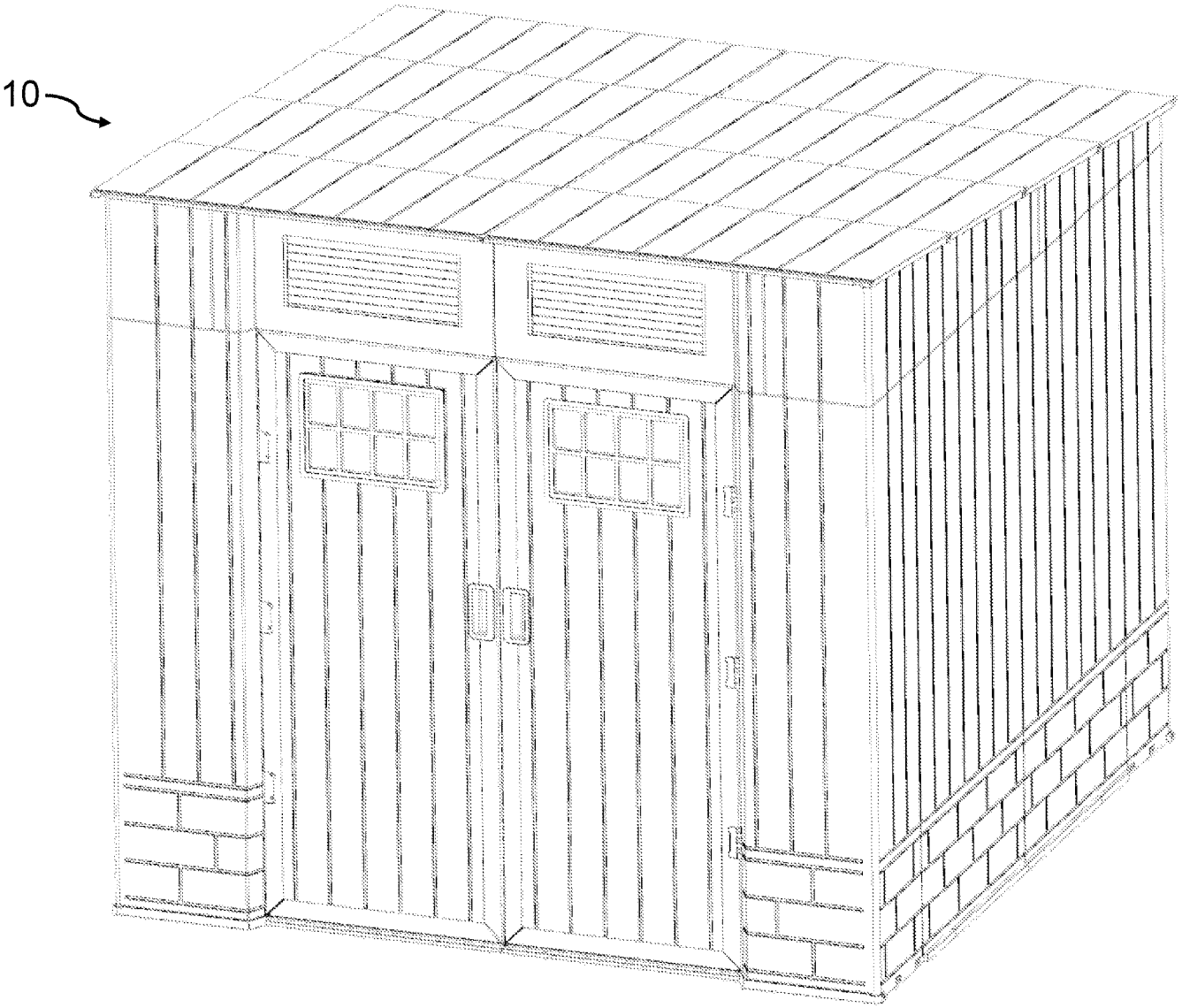
FIG. 1 is a perspective view of an embodiment of the present subject matter with the front door closed.
Figure 2:
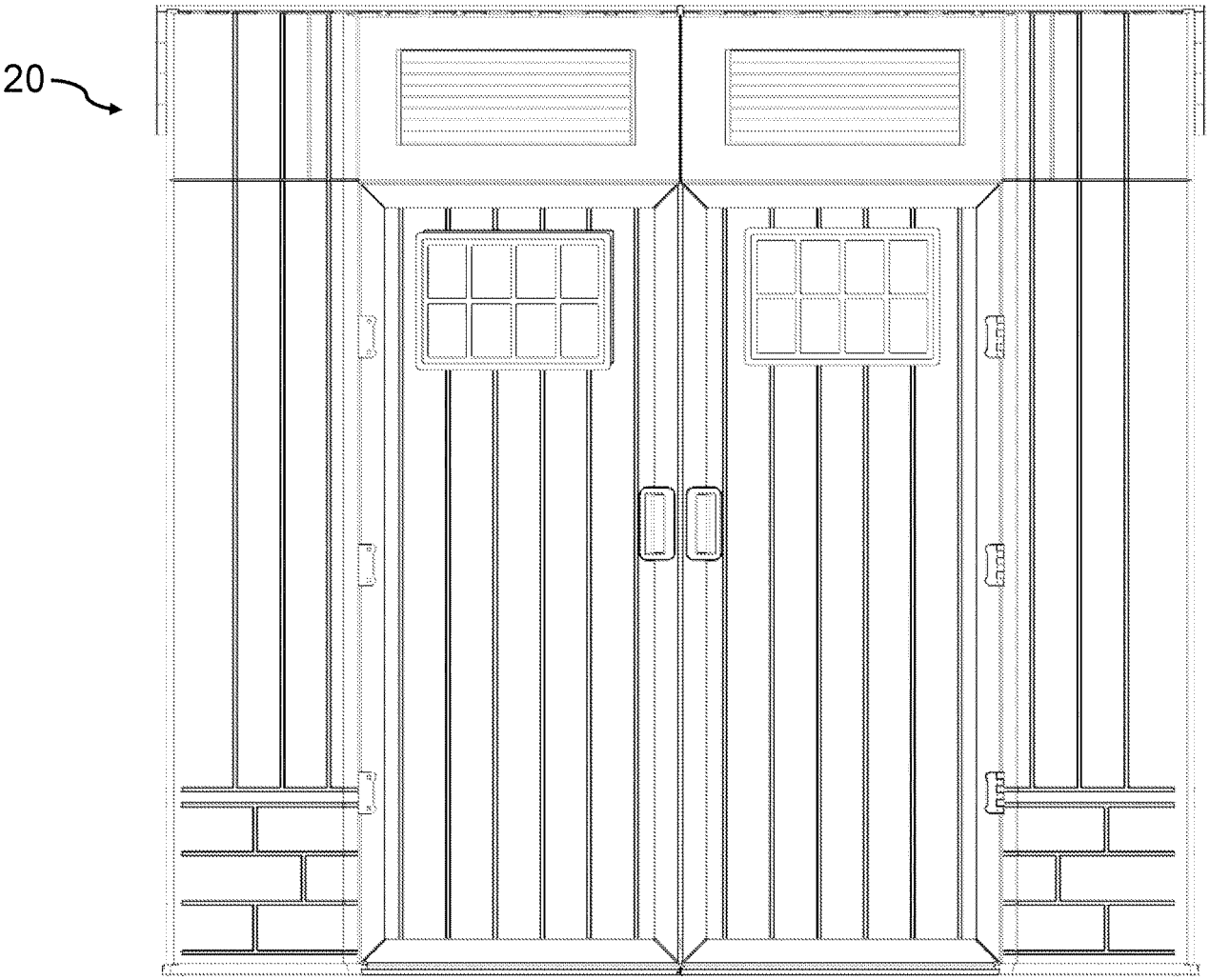
FIG. 2 is a front view of an embodiment of the present subject matter.
Figure 3:
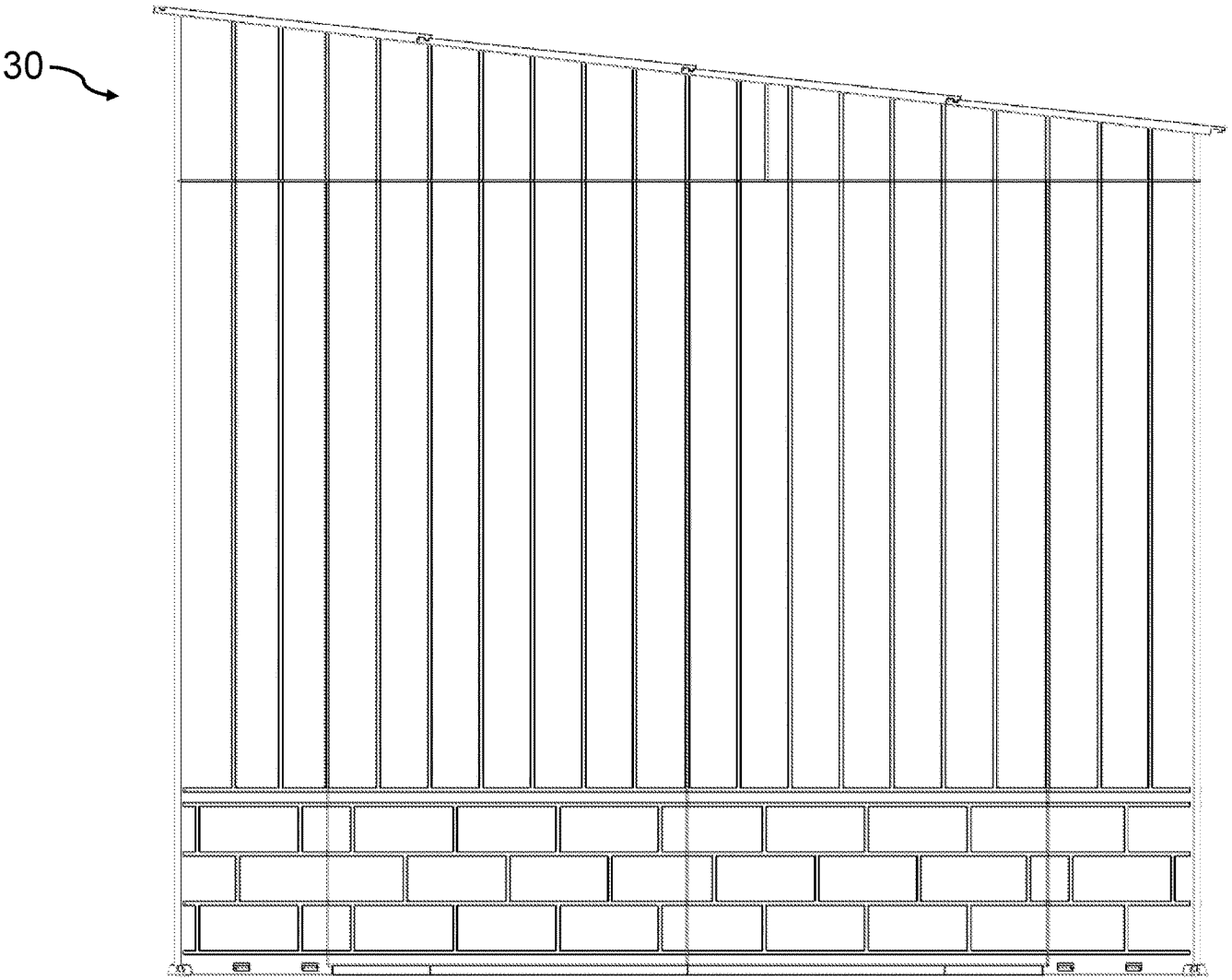
FIG. 3 is a first side view of an embodiment of the present subject matter.
Figure 4:
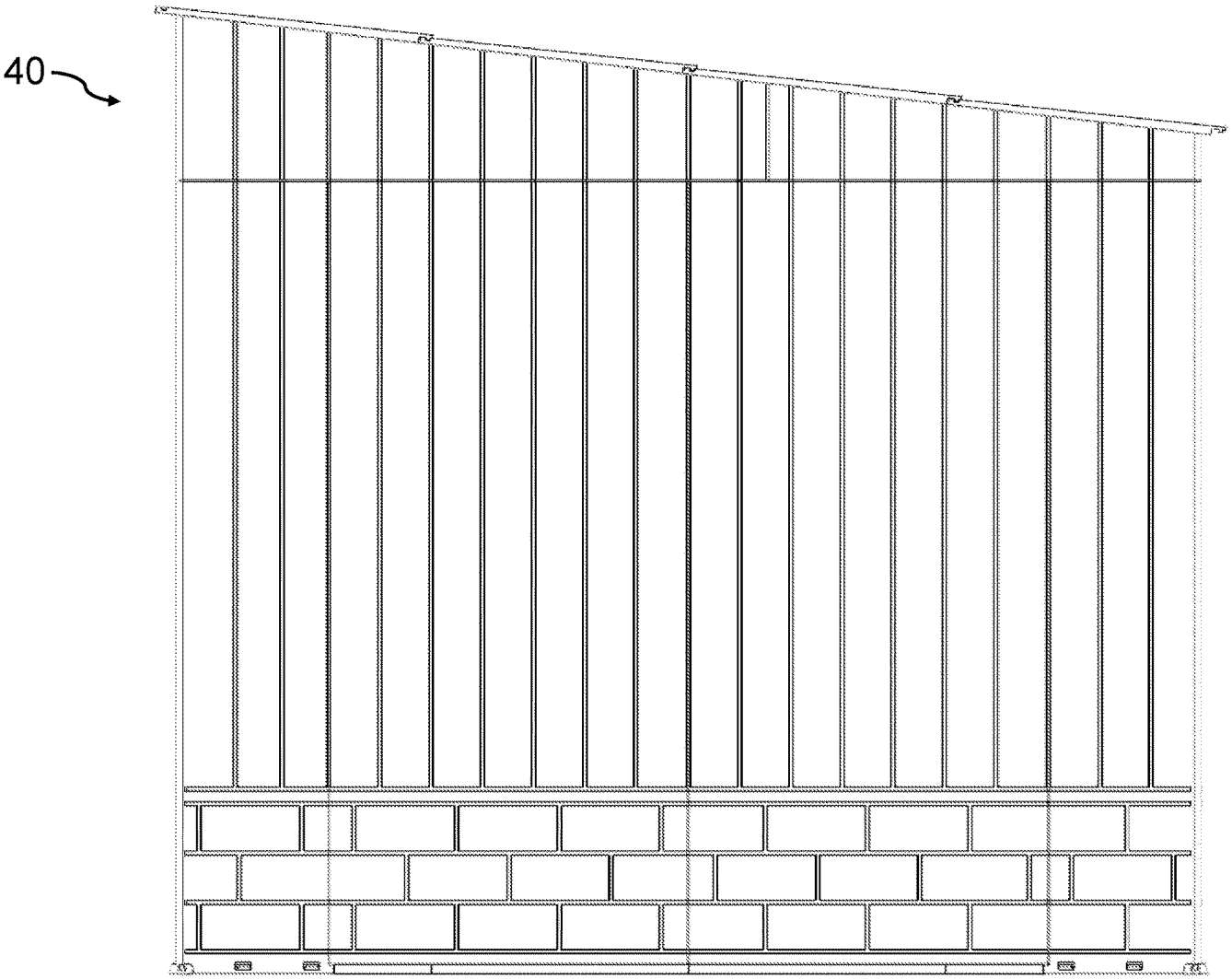
FIG. 4 is a second side view of an embodiment of the present subject matter.
Figure 5:
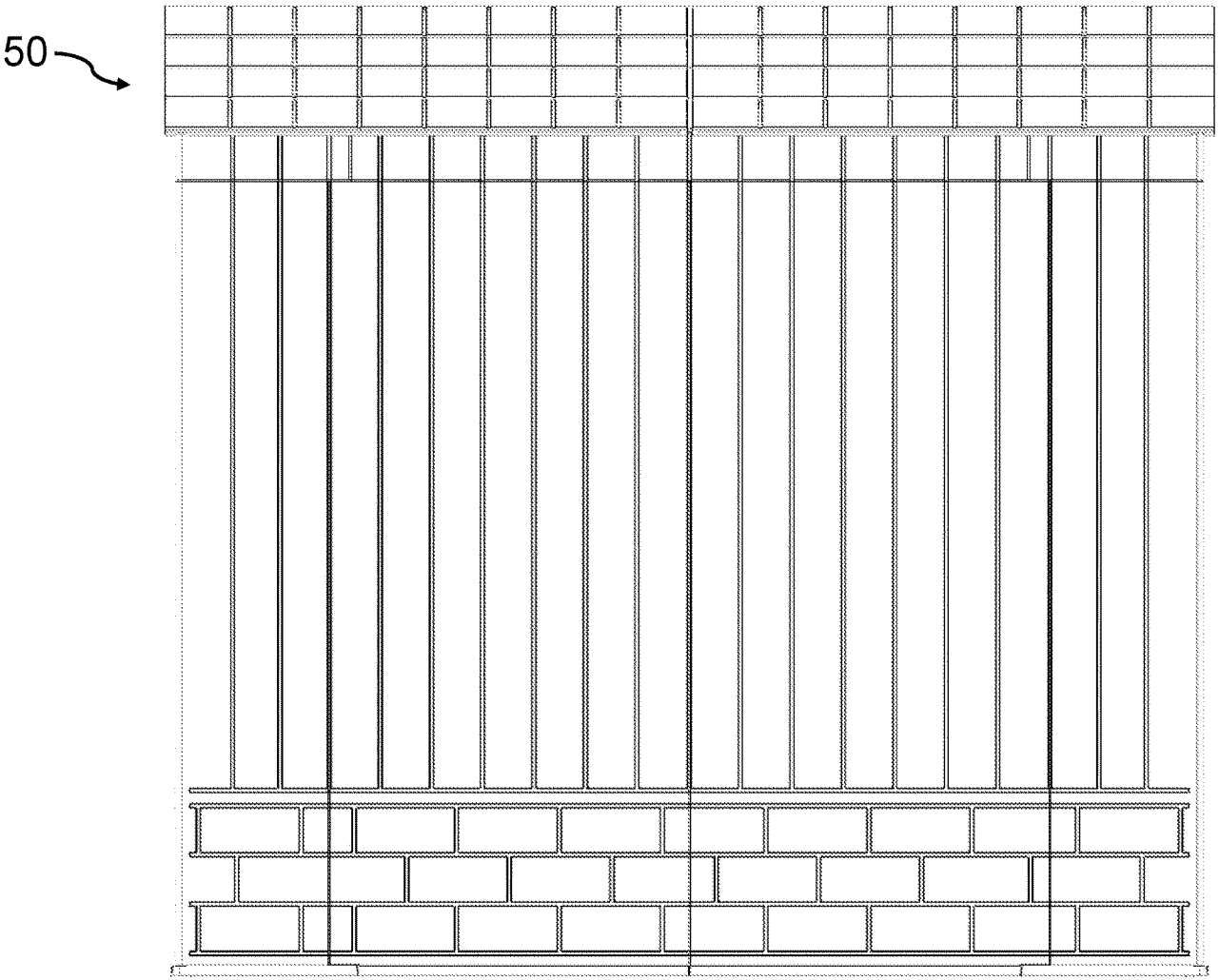
FIG. 5 is a rear view of an embodiment of the present subject matter.
Figure 6:
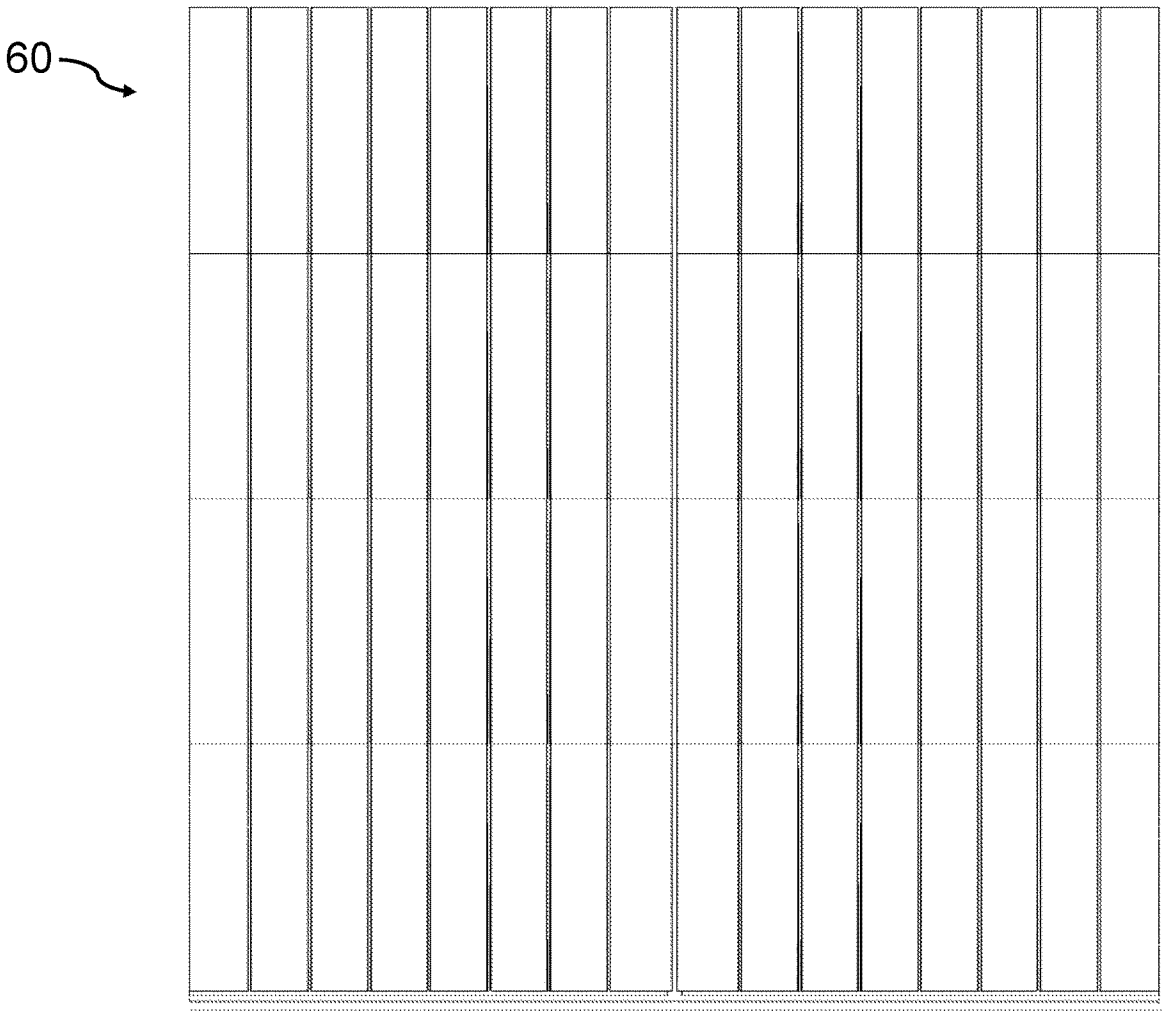
FIG. 6 is a top plan view of an embodiment of the present subject matter.

FIG. 1 is a perspective view 10 of an outdoor storage shed. The outdoor storage shed 10 can be made of molded plastic components or non-molded plastic panels that are durable and versatile. The plastic panels can be configured and manufactured in a substantially similar shape and size. This way, the package of the panels is more compact, resulting in reduced transportation cost. FIG. 2 is a front view 20 of an outdoor storage shed. FIG. 3 is a first side view 30 of an outdoor storage shed. FIG. 4 is a second side view 40 of an outdoor storage shed. FIG. 5 is a rear view 50 of an outdoor storage shed. FIG. 6 is a top view 60 of an outdoor storage shed.

Figure 7:
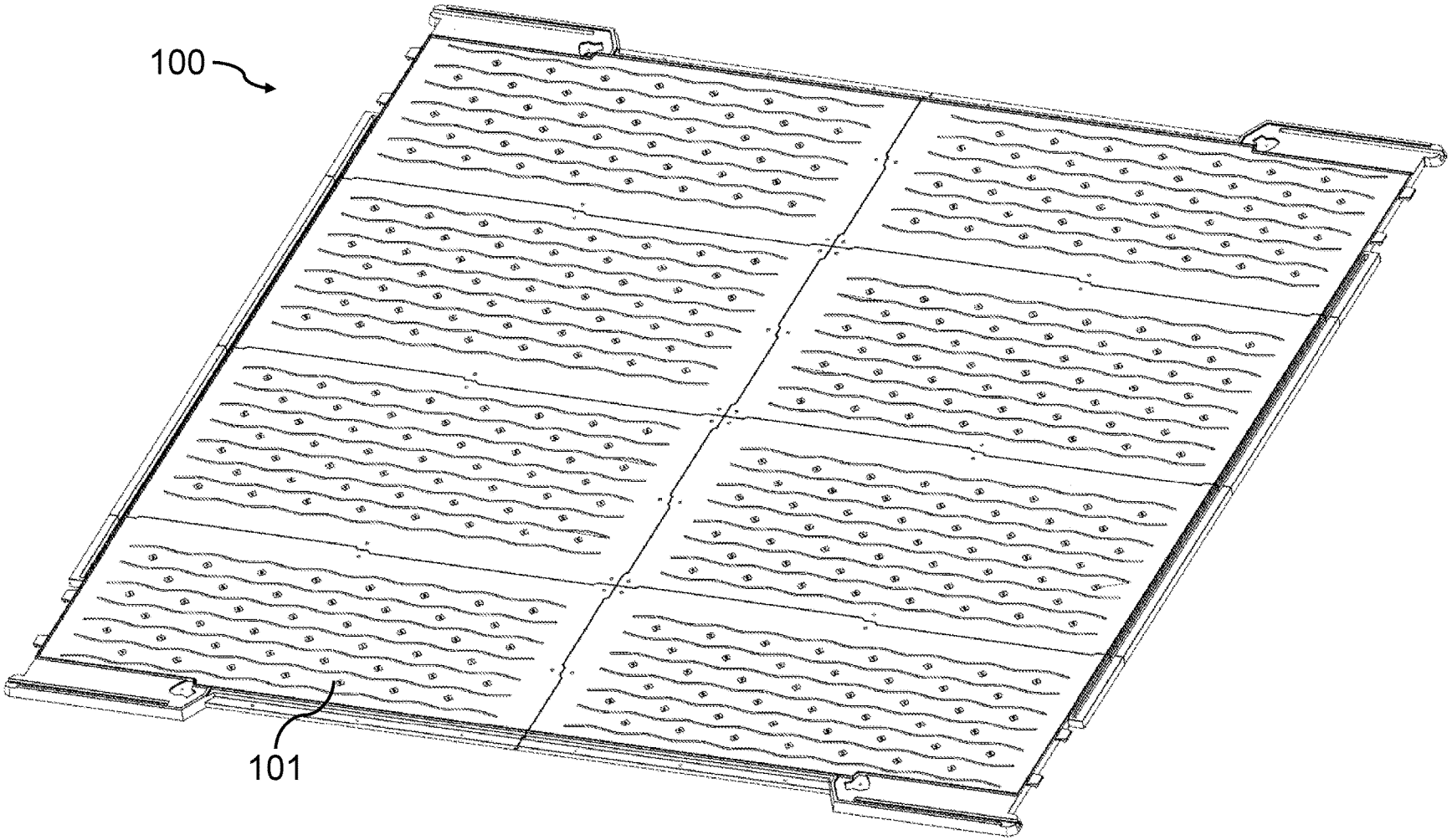
FIG. 7 is an exterior view of a floor of an embodiment of the present subject matter.

FIG. 7 is an exterior view of a floor 100 of an embodiment of the present subject matter. It shows the floor exterior 101 when floor 100 has been constructed by assembling a number of molded plastic panels. Floor 100 can provide a ground covering for a storage shed structure, which can not only provide an even surface but also prevent rain and dirt to enter the shed.

Figure 8:
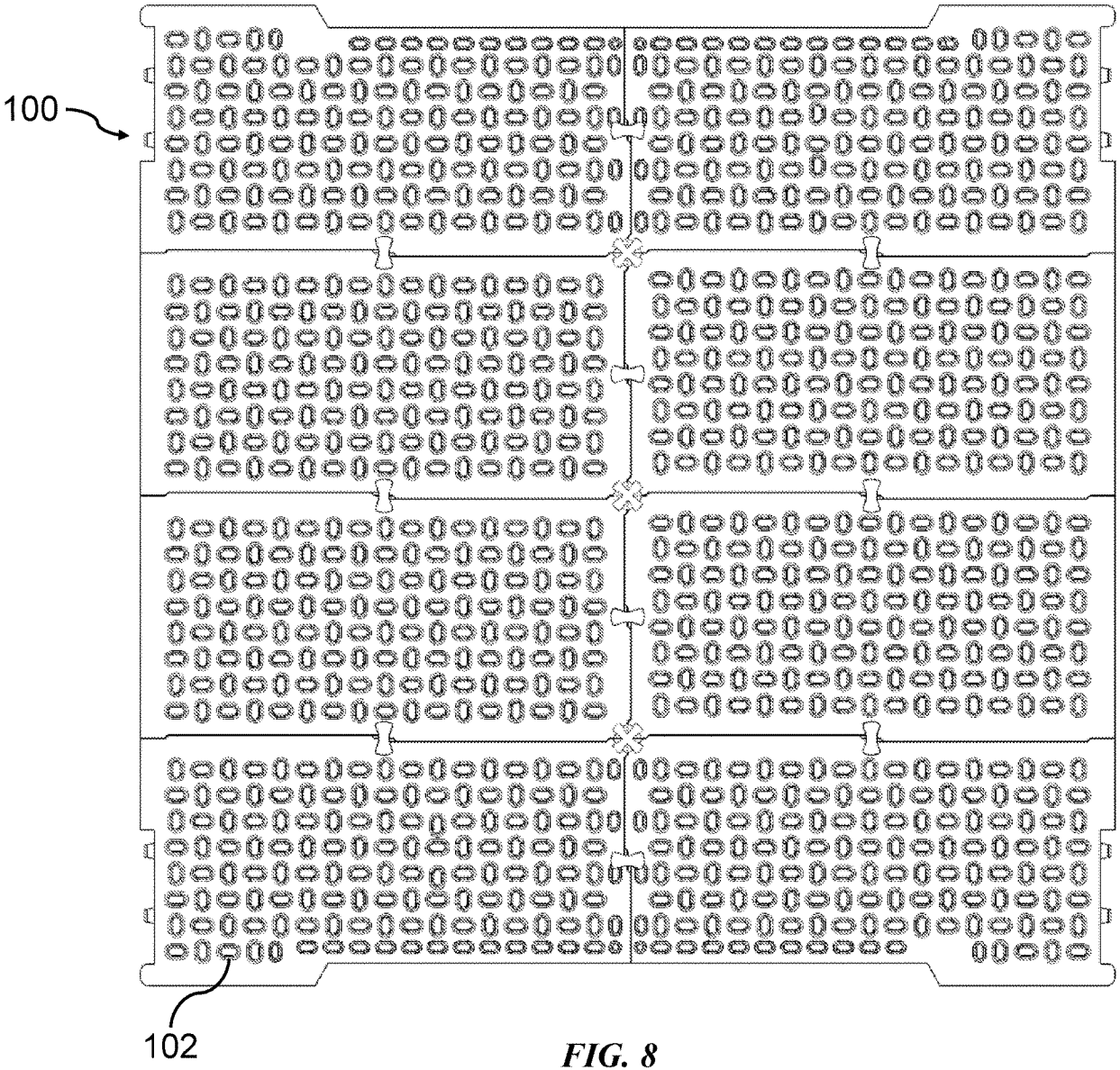
FIG. 8 is an interior view of a floor of an embodiment of the present subject matter.

FIG. 8 is an interior view of a floor 100 of an embodiment of the present subject matter. It shows the floor interior 102 when floor 100 has been assembled. As shown in this drawing, evenly spaced and symmetrically arranged back strengthening ribs are arranged in the floor interior 102 to provide enhanced stability of the plastic panel. According to some embodiments, such back strengthening ribs can comprise vertical support grooves and horizontal support grooves. In particular, each vertical support groove can be encircled by a plurality of horizontal support grooves. In addition, each horizontal support groove can be surrounded by a plurality of vertical support grooves.

Figure 9:
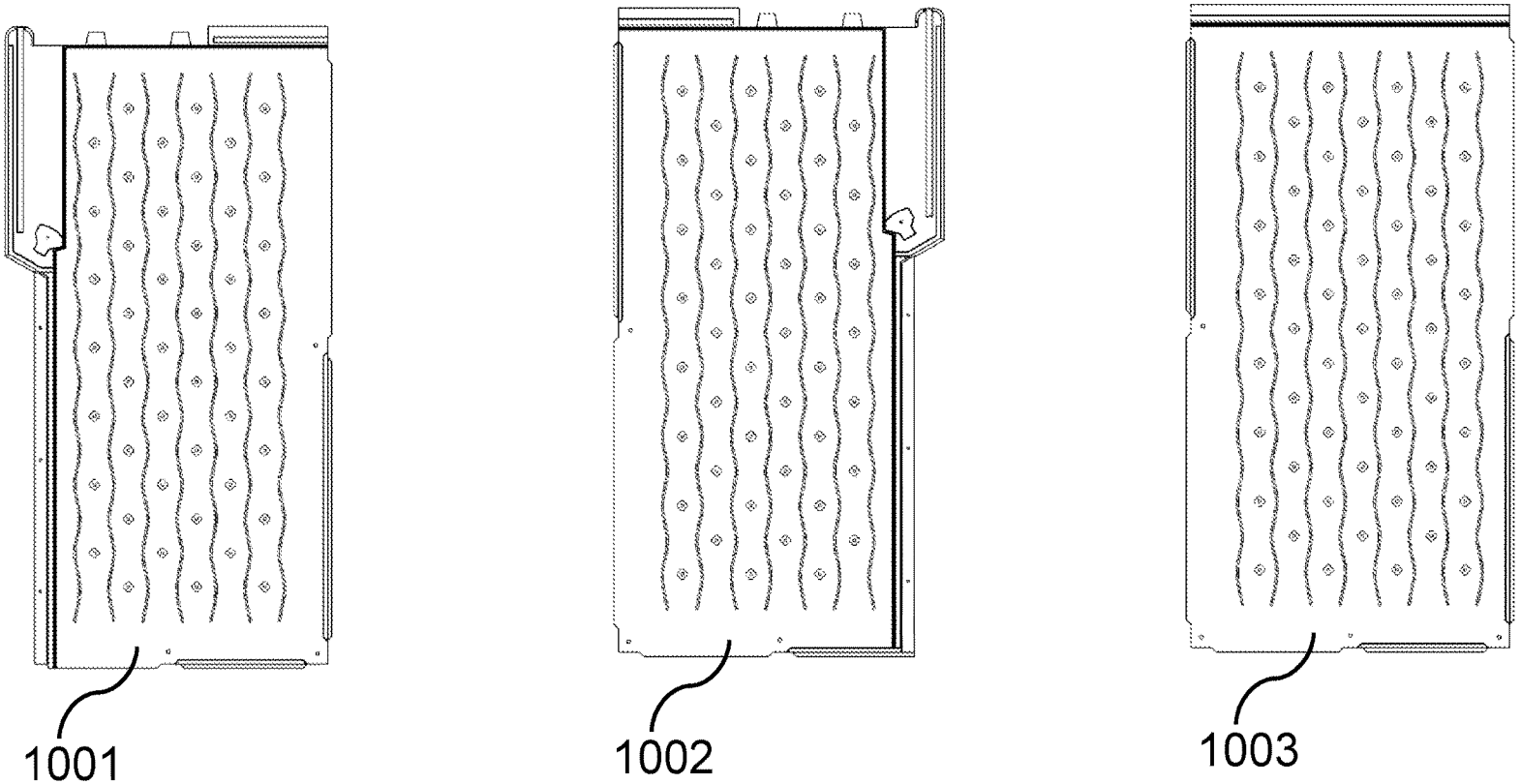
FIG. 9 shows multiple uninstalled floor panels of an embodiment of the present subject matter.

FIG. 9 shows multiple uninstalled individual floor panels of an embodiment of the present subject matter. The individual floor panels can comprise a first corner edge floor panel 1001, a second corner edge floor panel 1002, and a transitional floor panel 1003. A corner edge floor panel, serving as the corner of a floor, can have two sides that can be coupled with wall panels. A transitional floor panel, which can be positioned in a non-corner location, may have one or none side available for connection to the wall panel(s).

Figure 10:
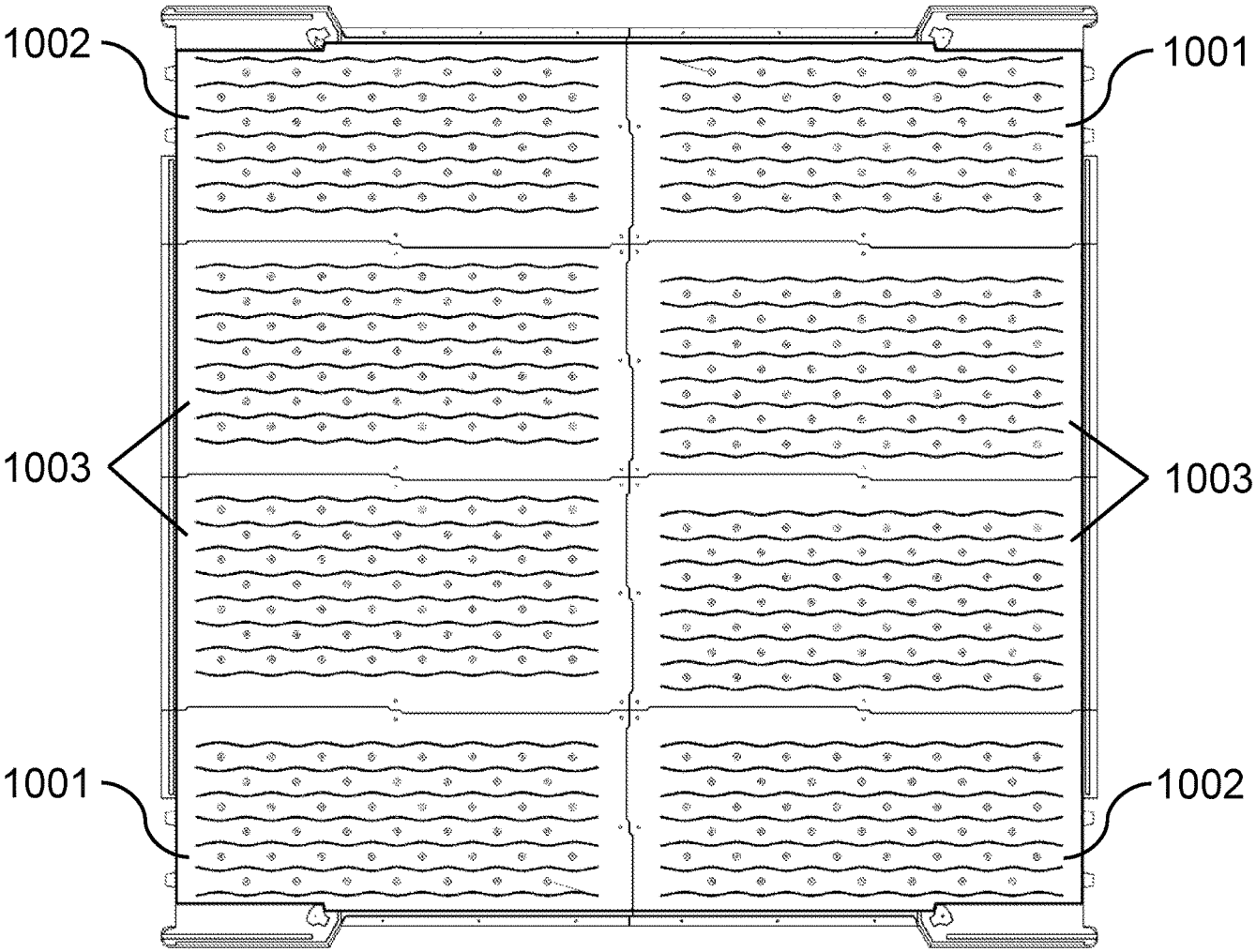
FIG. 10 shows multiple installed floor panels of an embodiment of the present subject matter.

FIG. 10 shows multiple installed floor panels of an embodiment of the present subject matter. As shown in this drawing, first corner edge floor panel 1001 and second corner edge panel 1002 can function as corners of a floor, while transitional floor panel 1003 can be inserted in between the corner panels to constitute a portion of the floor. According to some embodiments, additional transitional floor panels can be added to extend the size of the floor to render a customizable-sized storage room. To make such extensions and adjustments possible, each floor panel can be substantially identical in shape and size, thereby further enhancing the efficiency of product packaging and transportation.

Figure 11:
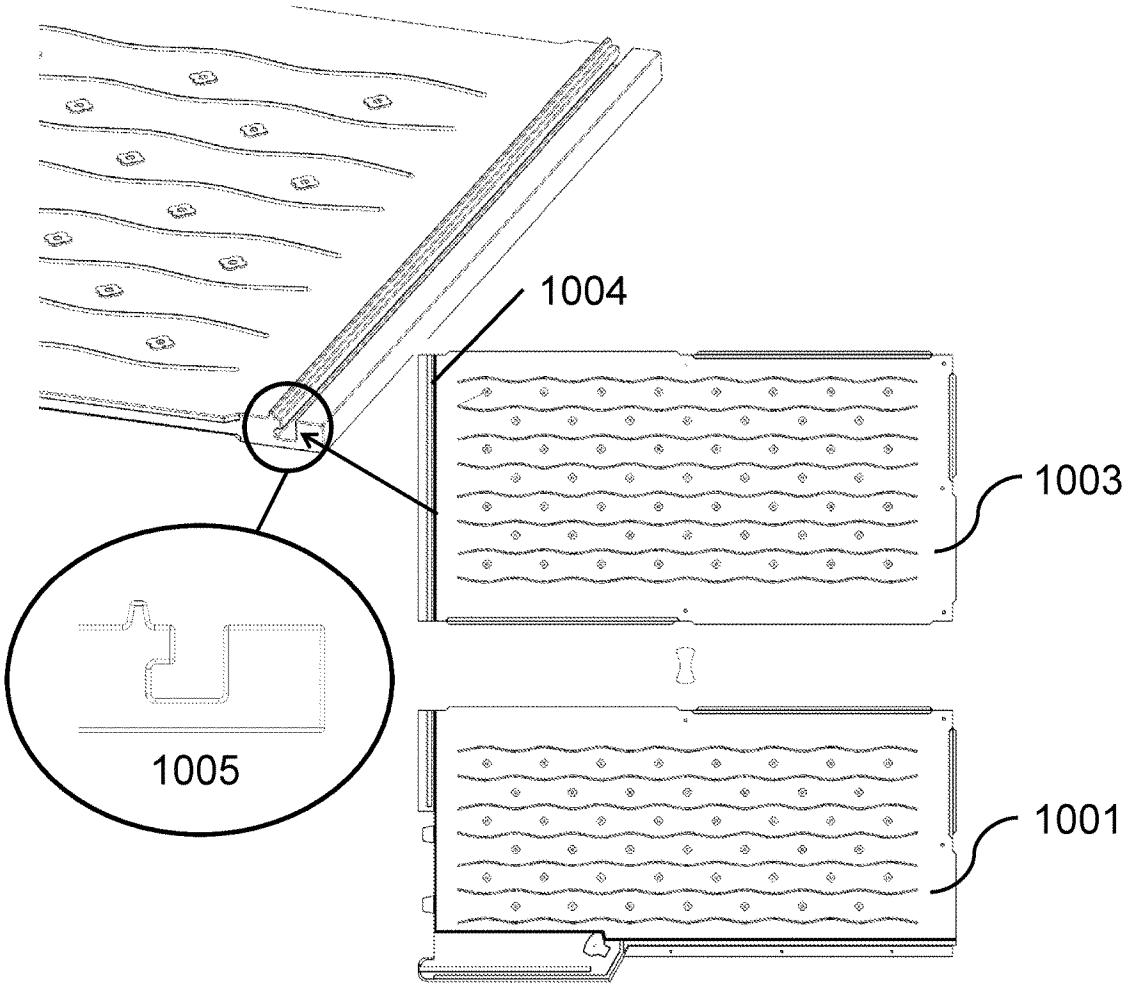
FIG. 11 shows an exploded view of an embodiment of the present subject matter.

FIG. 11 shows an exploded view of an embodiment of the present subject matter. First corner edge floor panel 1001 can be joined to the transitional floor panel 1003 using interlocked teeth couplings and supplementary connectors. According to some embodiments, the transitional floor panel 1003's first side has a first slider rail 1004, which could feature an L-shaped groove or rail 1005 designed to accommodate an L-shaped slider located on a wall panel. In other embodiments, the slider rail can incorporate a T-shaped or differently-shaped groove designed to house a corresponding slider for connecting with a wall panel.

First corner edge floor panel 1001 can be coupled to transitional floor panel 1003 via interlocked teeth couplings and additional connectors. According to some embodiments, a first side of transitional floor panel 1003 has a first slider rail 1004, which could comprise a L-shaped groove or rail 1005 configured to receive a L-shaped groove arranged on a wall panel. According to some embodiments, the slider rail could be a T-shaped or differently-shaped groove configured to received a corresponding slider for coupling with a wall panel.

Figure 12:
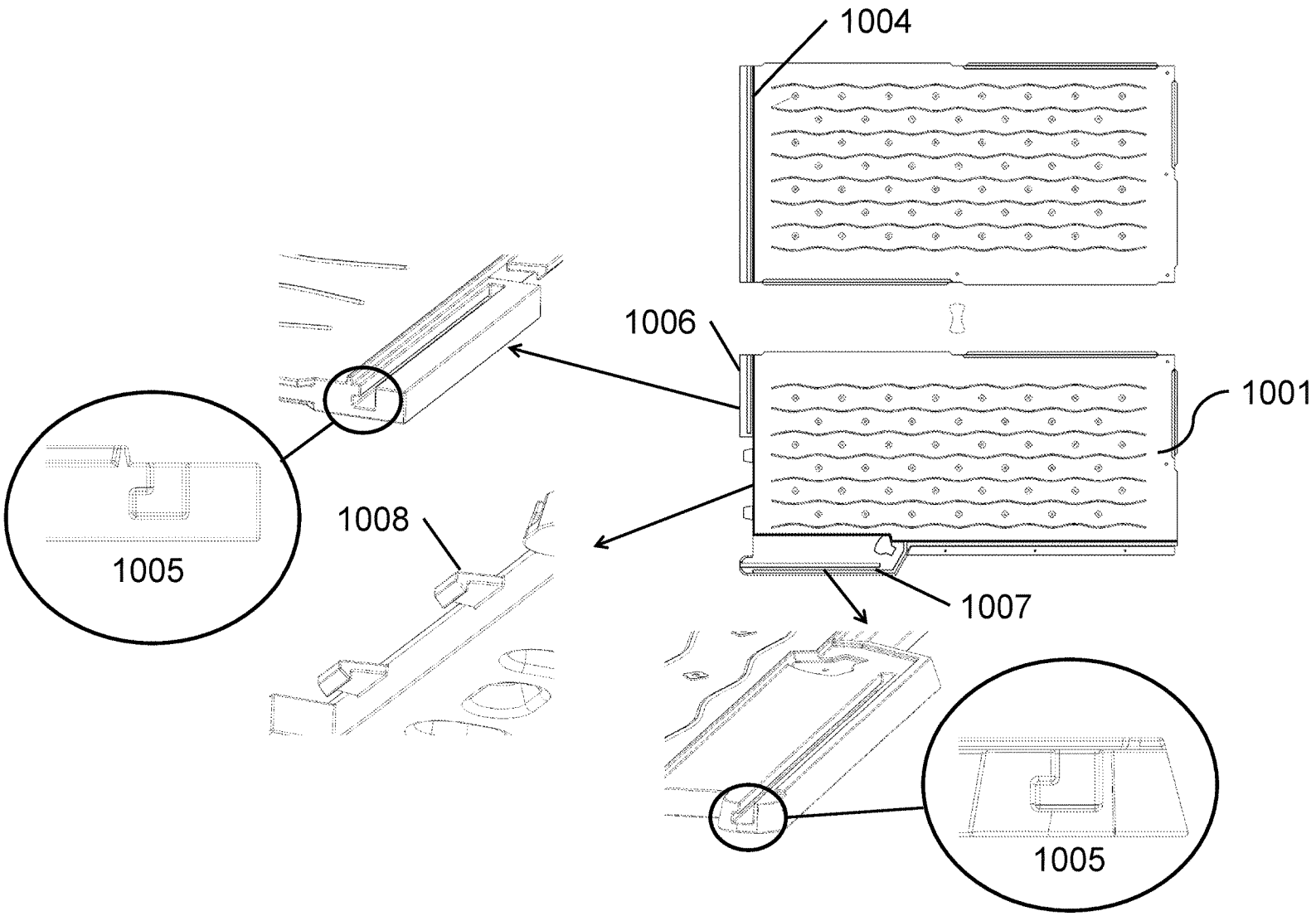
FIG. 12 shows another exploded view of an embodiment of the present subject matter.

FIG. 12 shows another exploded view of an embodiment of the present subject matter. As shown in this drawing, a first side of corner edge floor panel 1001 has a second slider rail 1006 designed to continue from the first slider rail 1004.

The second slider rail 1006 can comprise a L-shaped groove 1005 that is configured to receive the same L-shaped slider arranged on a wall panel. In addition, the first side of the corner edge floor panel 1001 further has one or more clips 1008 configured to engage with clip slots arranged on the wall panel.

According to some embodiments, a corner edge floor panel 1001 can incorporate two distinct coupling mechanisms on the same side. For example, a slider coupling, such as 1006, can be positioned adjacent to and in alignment with clips 1008. Consequently, a wall panel that couples to the corner edge floor panel can possess two corresponding coupling structures, such as a slider bar and clip slots, on the same side. Furthermore, these two different coupling mechanisms can each employ a contrasting engagement style, i.e., projecting vs. receiving, to enhance the connecting force and stability between the panels. For example, a panel can feature a projected coupling portion, like clips, on one side, and a receiving coupling portion, such as a slider rail, on another side.

According to some embodiments, a second side of corner edge floor panel 1001 has a third slider rail 1007 that comprises another L-shaped groove 1005 for coupling to another wall panel. According to some embodiments, the second side of corner edge floor panel 1001 can have a different coupling portion, such as clips or clip slots.

Figure 13:
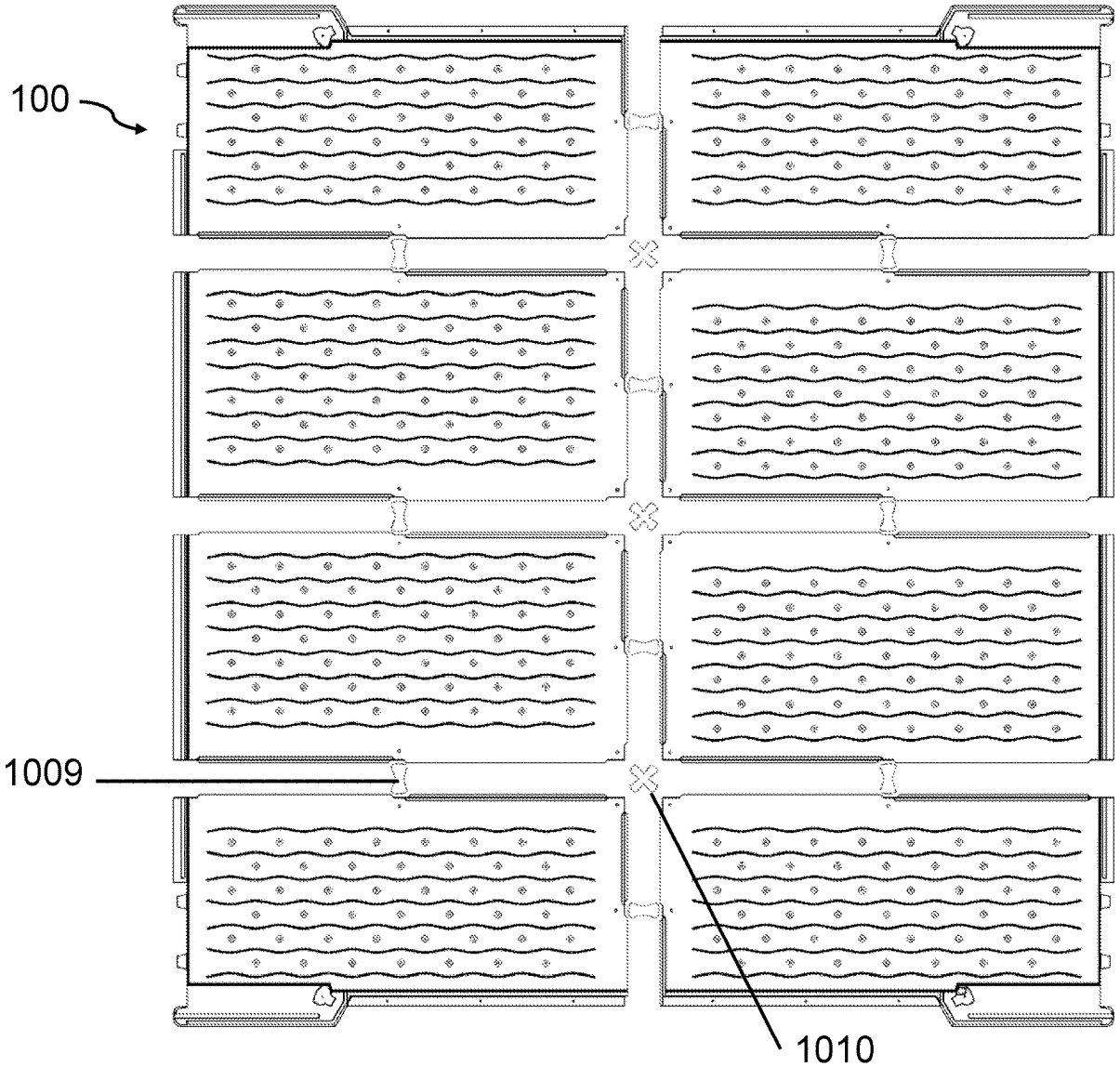
FIG. 13 shows multiple installed floor panels via connectors, according to an embodiment of the present subject matter.

FIG. 13 shows multiple installed floor panels via connectors, according to an embodiment of the present subject matter. Floor 100 can comprise corner edge floor panels and transitional floor panels that are connected by more than one coupling mechanism. For example, butterfly connector 1009 can fix two coupled panel boards, whereas cross connector 1010 can secure four coupled panel boards.

Figure 14:
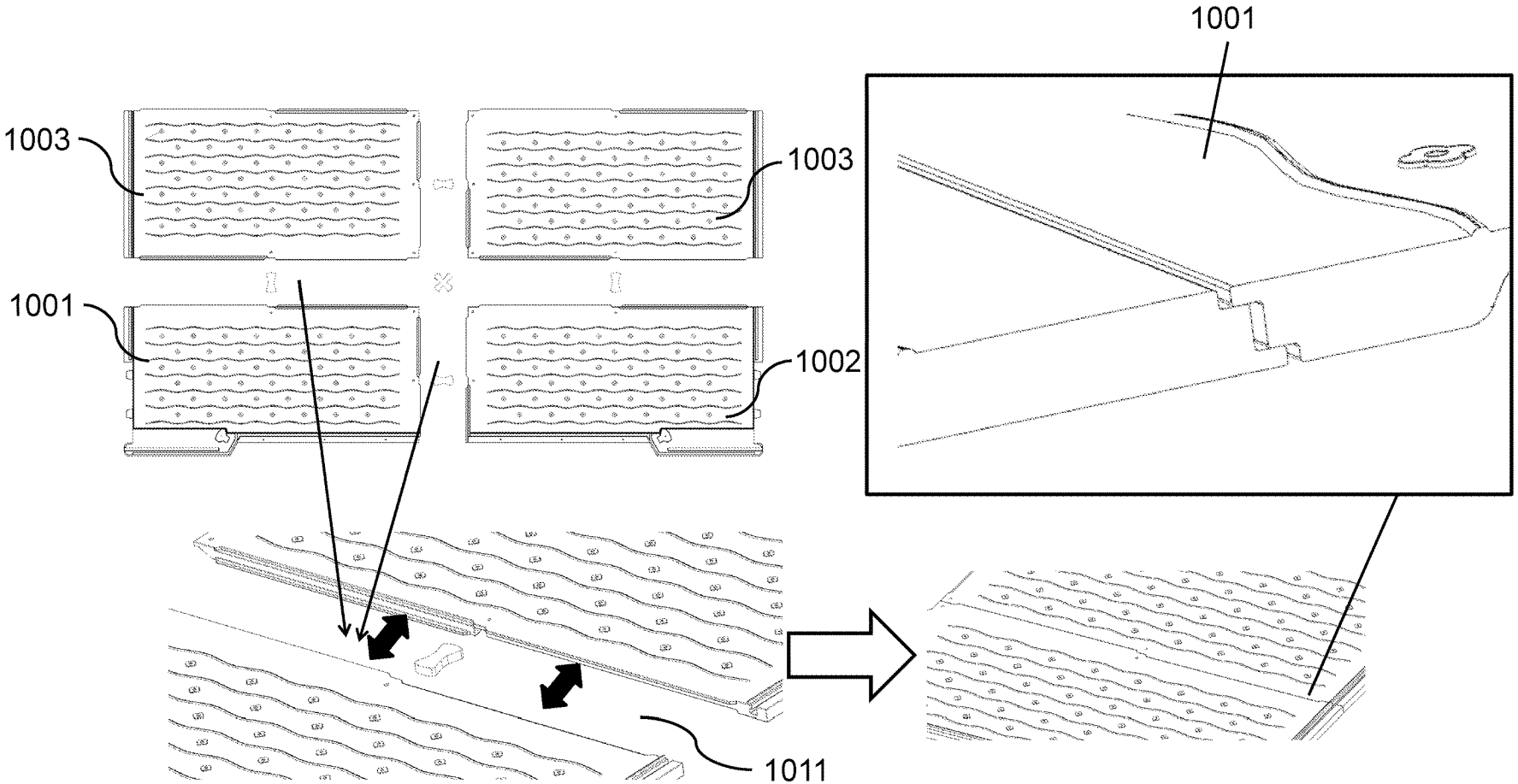
FIG. 14 shows multiple installed floor panels via connectors and interlocked teeth couplings, according to an embodiment of the present subject matter.

FIG. 14 shows multiple installed floor panels via connectors and interlocked teeth couplings, according to an embodiment of the present subject matter. A plurality of interlocked teeth couplings 1011 can securely connect two neighboring panels, e.g., first corner edge floor panel 1001 and transitional floor panel 1003, first corner edge floor panel 1001, and second corner edge floor panel 1002. The interlocked teeth couplings can have corresponding ledged portions that match each other to provide more surface contact and support, as shown in the exploded view. Furthermore, the interlocked teeth couples can create a straight and simple seam on the exterior side of the connected panels.

Figure 15:
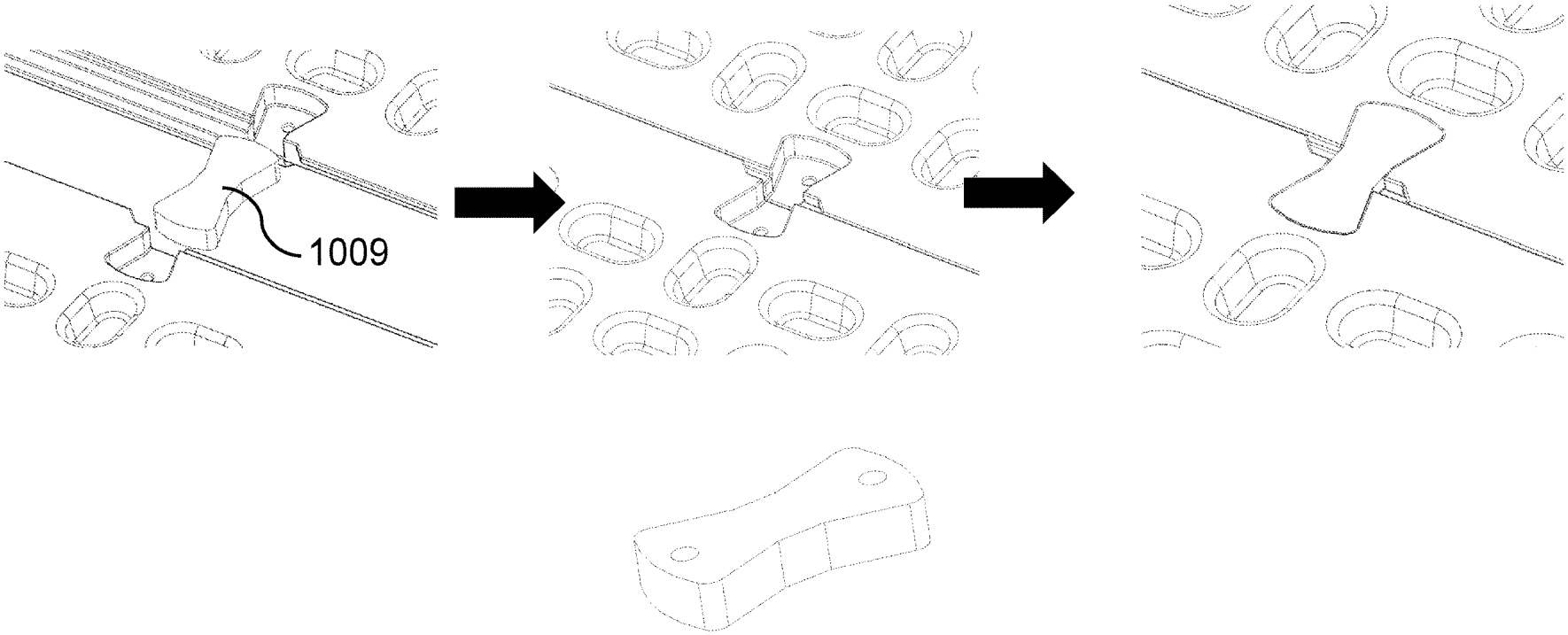
FIG. 15 shows an exploded view of an embodiment of the present subject matter.

FIG. 15 shows an exploded view of an embodiment of the present subject matter. As shown in these drawings, a butterfly connector 1009 can be inserted into the pre-manufactured slot formed by the two joined panels, which can be further affixed to the panels using a screw or another fastening tool.

Figure 16:
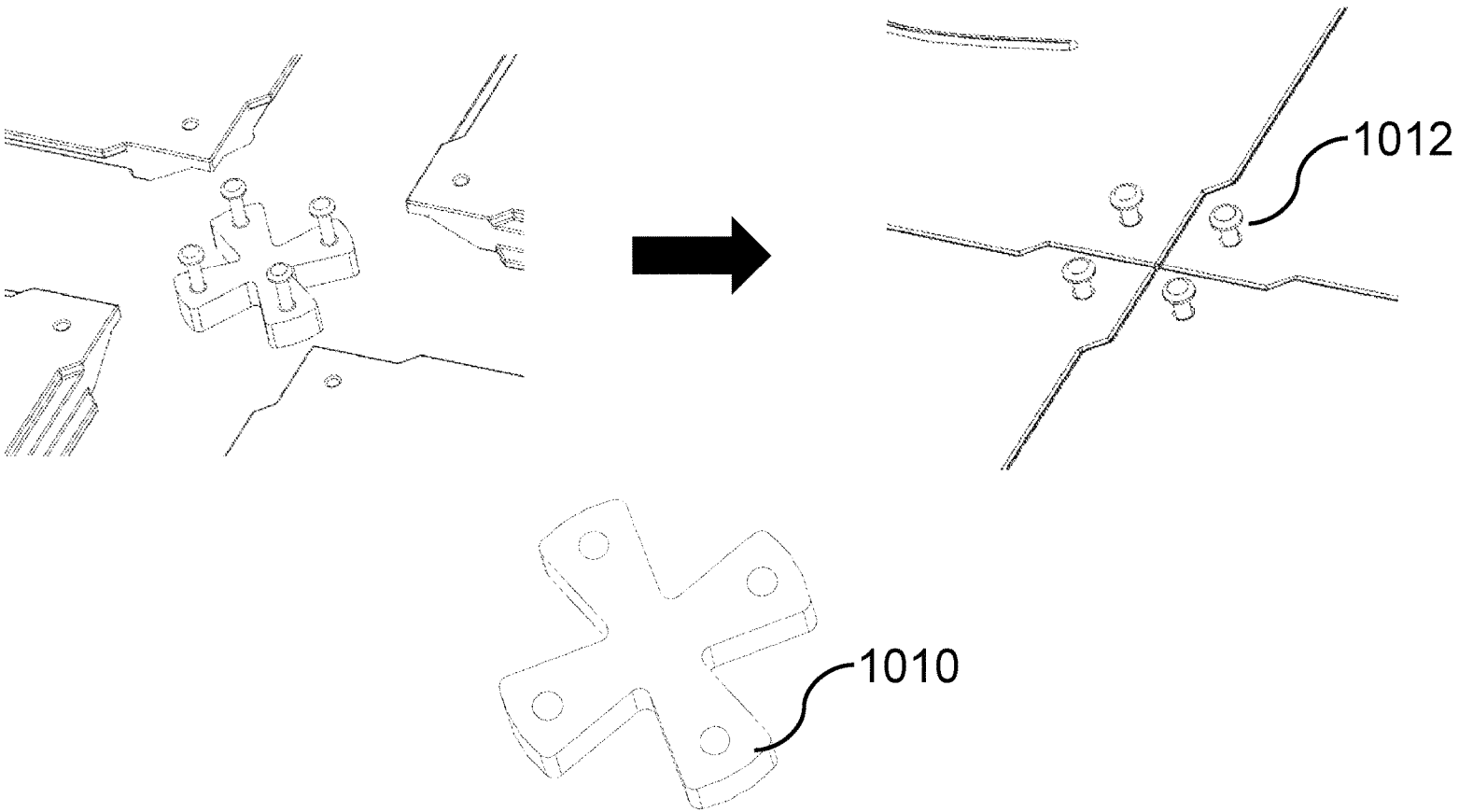
FIG. 16 shows another exploded view of an embodiment of the present subject matter.

FIG. 16 shows another exploded view of an embodiment of the present subject matter. According to some embodiments, a cross connector or a double-butterfly connector 1010 can be inserted into the pre-manufactured slot formed by four neighboring panels, which can be further affixed using a screw 1012 or another fastening tool.

Figure 17:
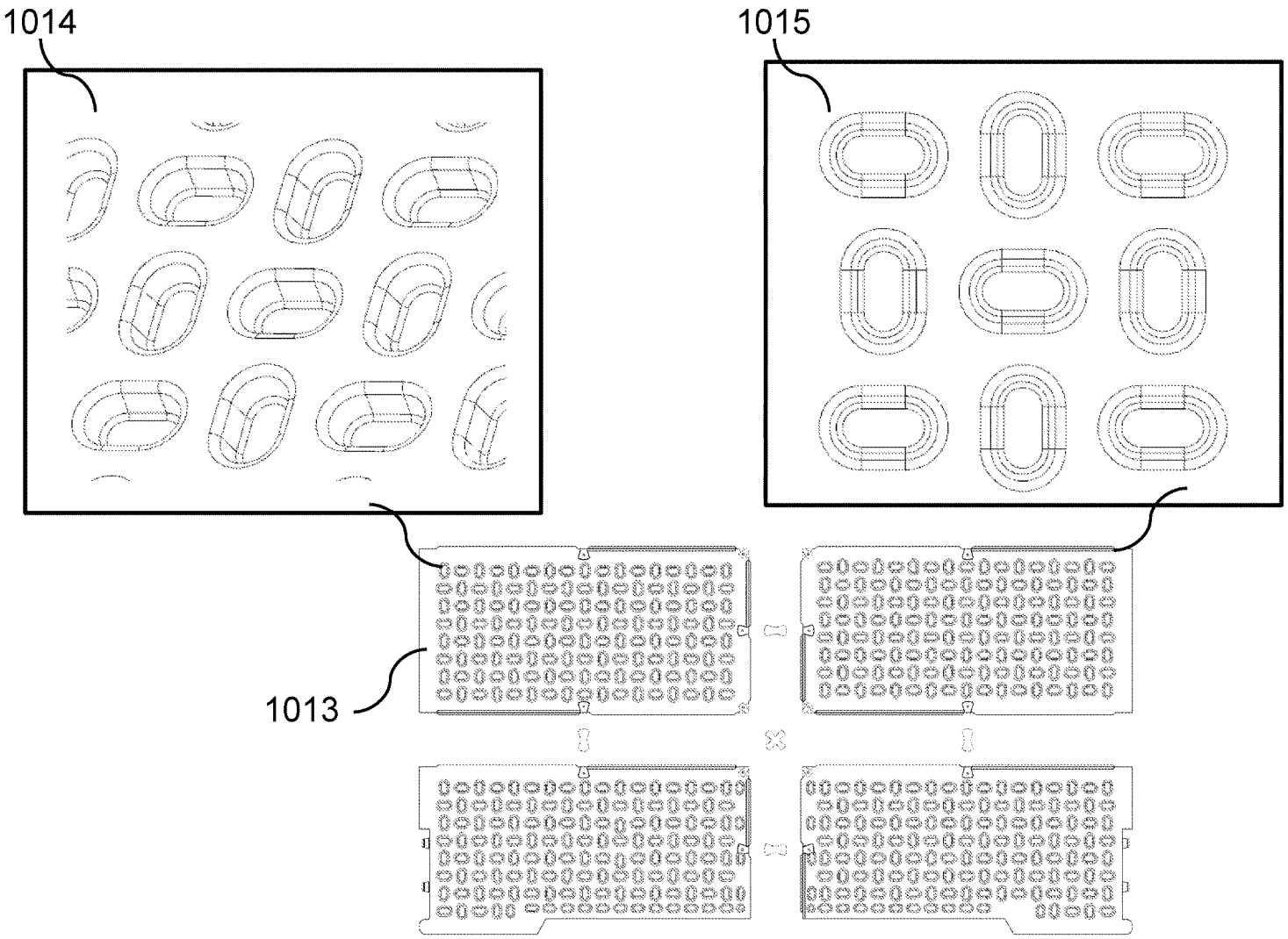
FIG. 17 shows back strengthening ribs of a molded plastic panel, according to an embodiment of the present subject matter.

FIG. 17 shows back strengthening ribs of a molded plastic panel, according to an embodiment of the present subject matter. A molded plastic panel can comprise a number of back strengthening ribs 1013 that comprise vertical support grooves and horizontal support grooves. A vertical or horizontal support groove can create an indent and touch point for the two layers of a molded plastic panel, which increase its durability and stability. In particular, each vertical support groove can be encircled by a plurality of horizontal support grooves. In addition, each horizontal support groove can be surrounded by a plurality of vertical support grooves. Such a balanced switch between the two orientations of the oval support grooves can maximize the intended benefits of the grooves. Furthermore, a side view 1014 of back strengthening ribs 1013 is displayed along with a top view 1015 of them.

Figure 18:
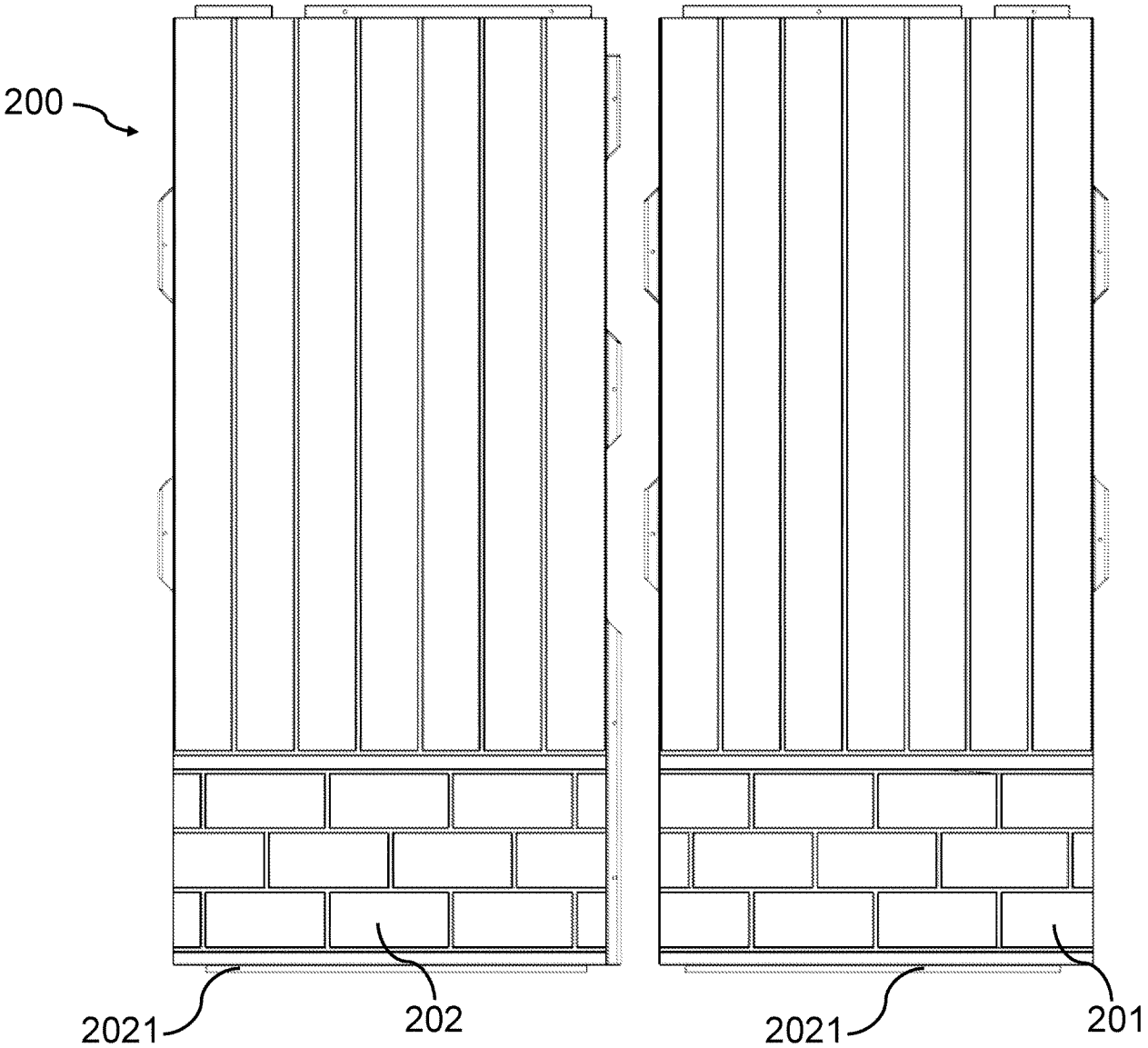
FIG. 18 shows a front view of flat wall panels, according to an embodiment of the present subject matter.

FIG. 18 shows a front view of flat wall panels, according to an embodiment of the present subject matter. According to some embodiments, the outdoor storage shed's side walls can consist of both flat panels and foldable corner panels, which can form the shed structure's four corners. Alternatively, according to some embodiments, the shed's side walls can include only foldable corner panels, thereby omitting any flat panels. As depicted in FIG. 18, the flat panel 200 may include a basic flat panel 201, which has symmetrical interlocking teeth or portions on both sides. There is also an extension flat panel 202 that can be optional and can be used for enlarging the storage shed. A slider rail 2021 for coupling with one or more floor panels can be arranged on the bottom side of the basic flat panel 201 and the extension flat panel 202.

Figure 19:
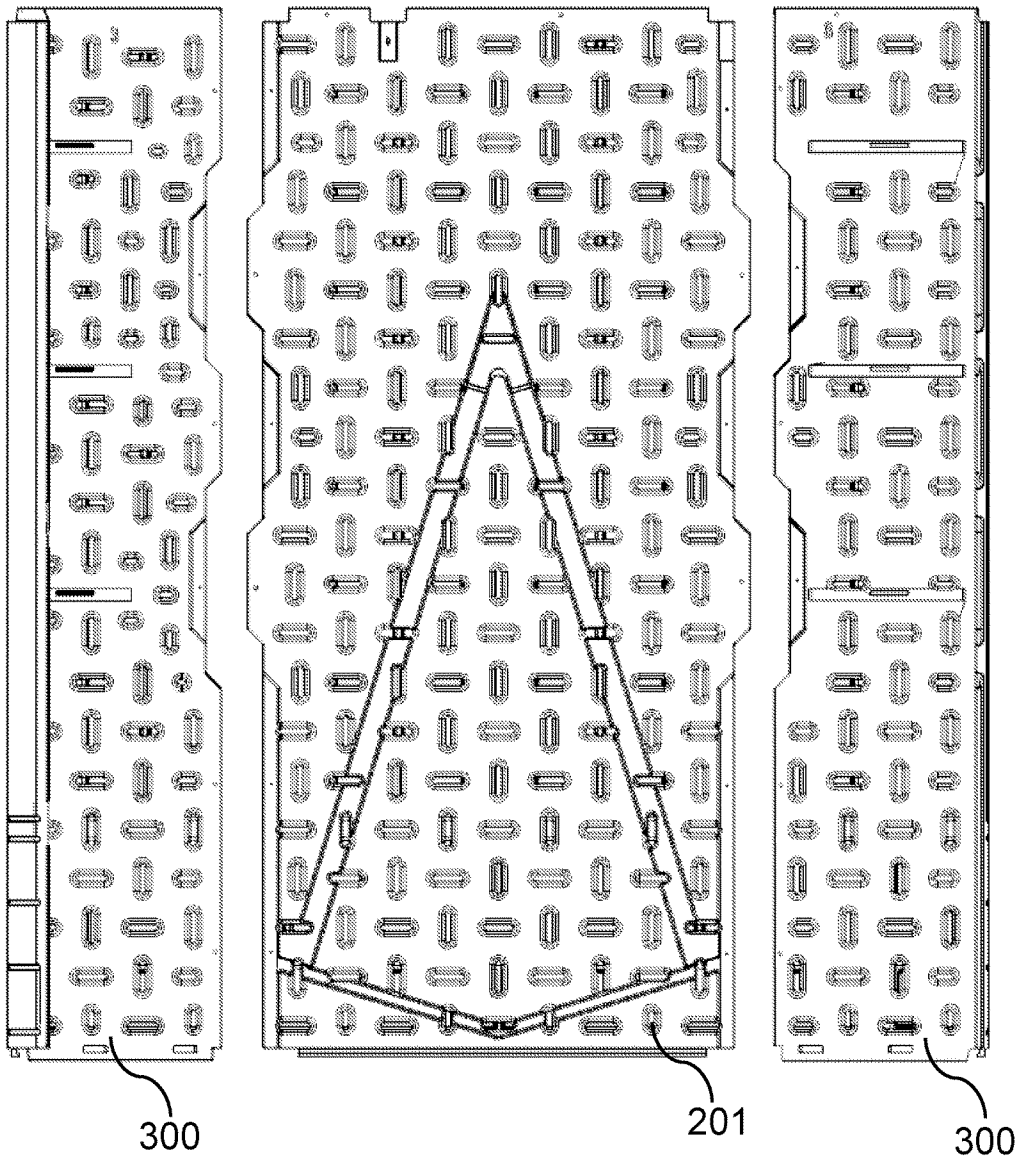
FIG. 19 shows a rear view of flat wall panel(s) and foldable corner panel(s), according to an embodiment of the present subject matter.

FIG. 19 shows a rear view of flat wall panel(s) and foldable corner panel(s), according to an embodiment of the present subject matter. A base flat panel 201 can have pre-manufactured integrated slots to store metal supporting beams during transportation. These metal support beams, once assembled and installed, can provide support for a designated section of the outdoor storage shed, such as the roof. As shown in this drawing, the base flat panel can be coupled to two foldable corner panels 300 via at least the interlocked teeth couplings.

Figure 20:
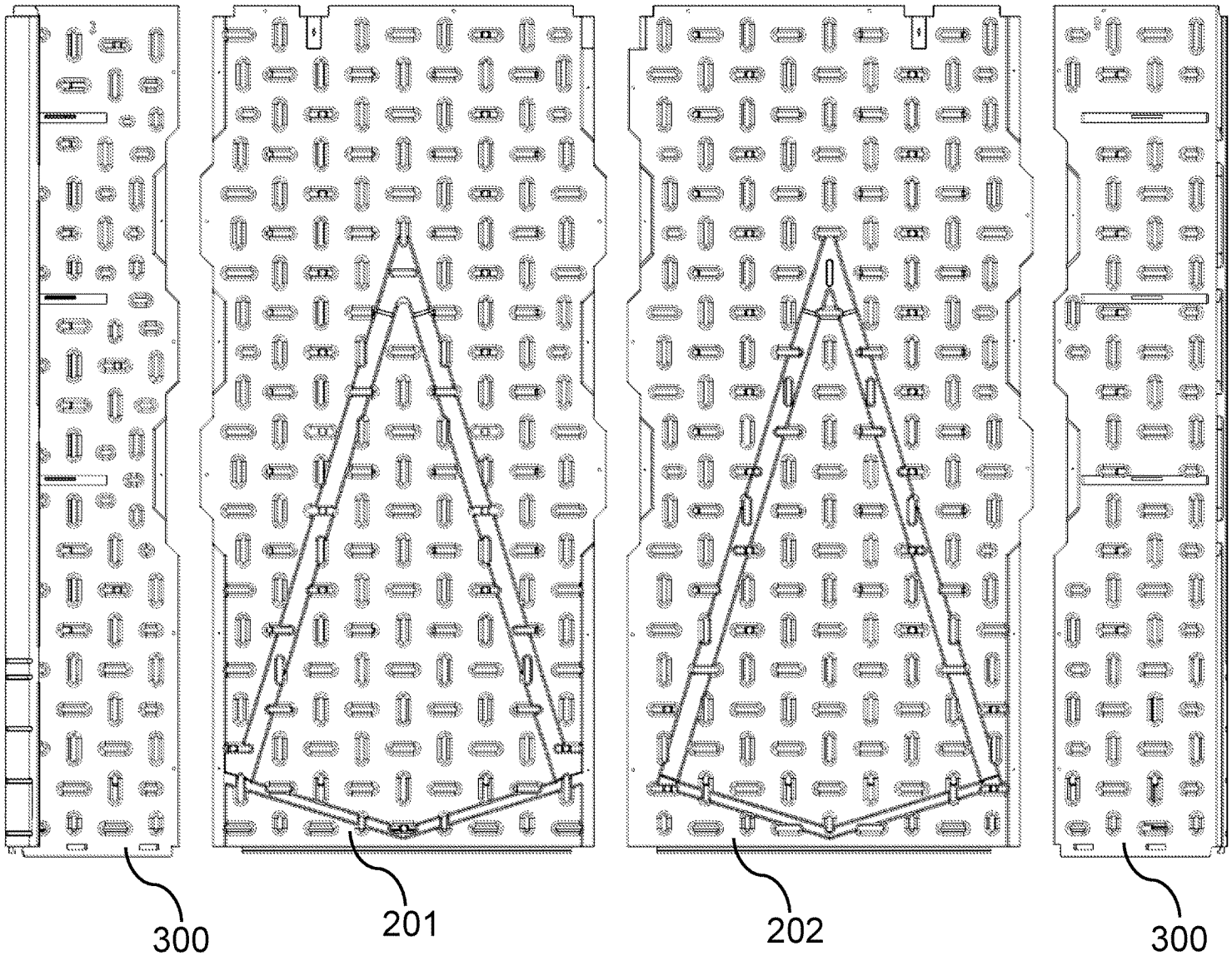
FIG. 20 shows another rear view of flat wall panel(s) and foldable corner panel(s), according to an embodiment of the present subject matter.

FIG. 20 shows another rear view of flat wall panel(s) and foldable corner panel(s), according to an embodiment of the present subject matter. Via interlocked teeth couplings, a basic flat panel 201 can be coupled with an extension flat panel 202 on a first side, and a foldable corner panel 300 on a second side. Additional extension flat panel 202 can be added to expand or customize the size of the storage shed. Another foldable corner panel 300 can be coupled to extension flat 202 to form a second corner of the shed. As shown in this drawing, during transportation, two sets of supporting beams can be stored within matching grooves embedded in the back of the plastic panels, which can save packaging space. Such supporting beams can be installed on-site to reinforce the shed's roofing assembly.

Figure 21:
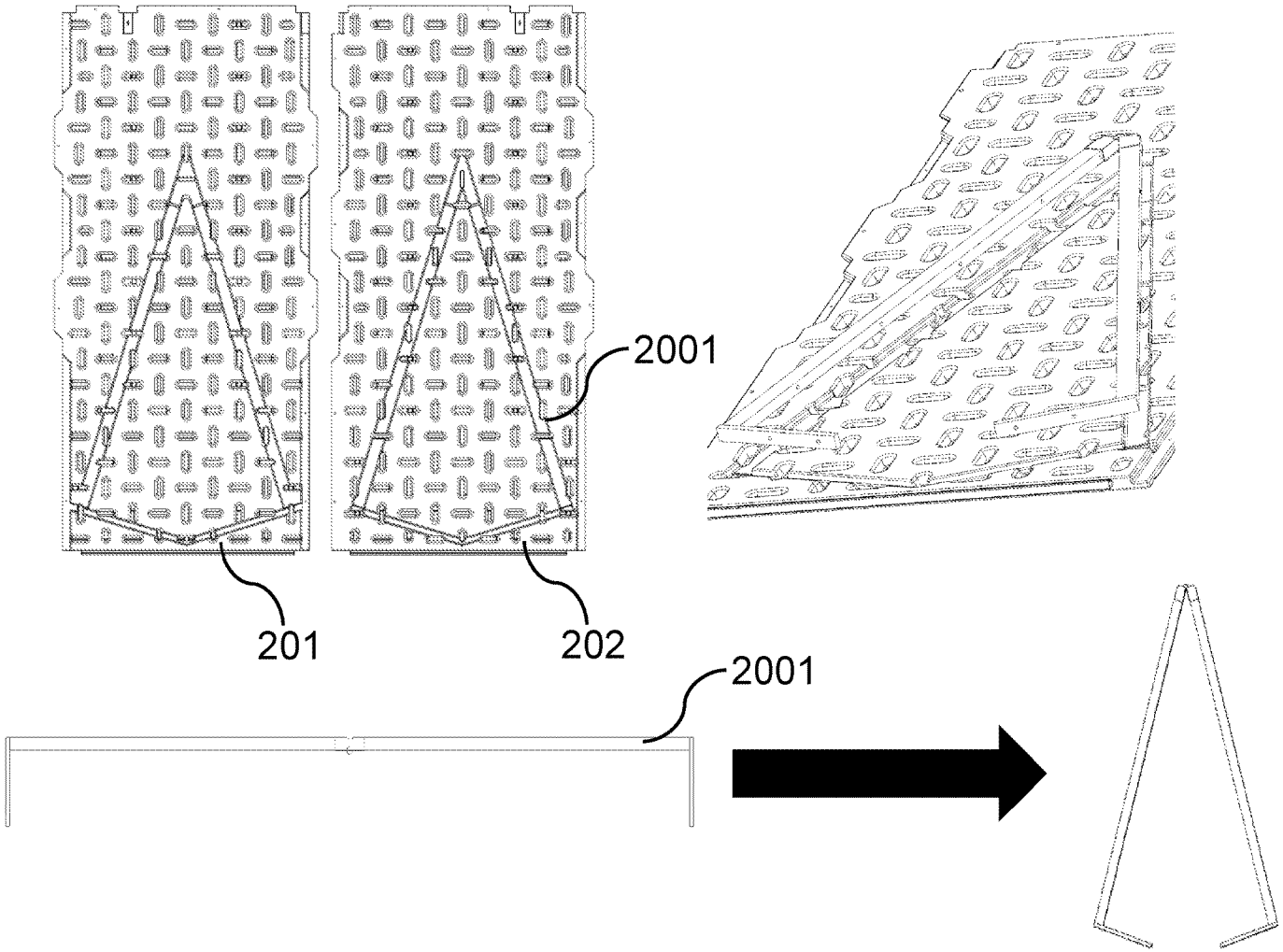
FIG. 21 shows a rear view of flat wall panels(s) with stored supporting beams, according to an embodiment of the present subject matter.

FIG. 21 shows a rear view of flat wall panels(s) with stored supporting beams, according to an embodiment of the present subject matter. Multiple supporting beams 2001 can be stored within the rear layer of a plastic molded panel, e.g., 201 and 202. As shown in this example, supporting beams can be split into two portions and connected via fastening tools during installation. To enable convenient retrieval by the user, the pre-manufactured beam slots that are integrated within the plastic layer can have a depth shallower or smaller than the depth of the supporting beams, e.g., half the depth. During transportation, a second panel, securely laying on top of the beam slots, can function as a fastener for the stored beams to prevent them from scratching and damaging other molded plastic panels in the package.

Figure 22:
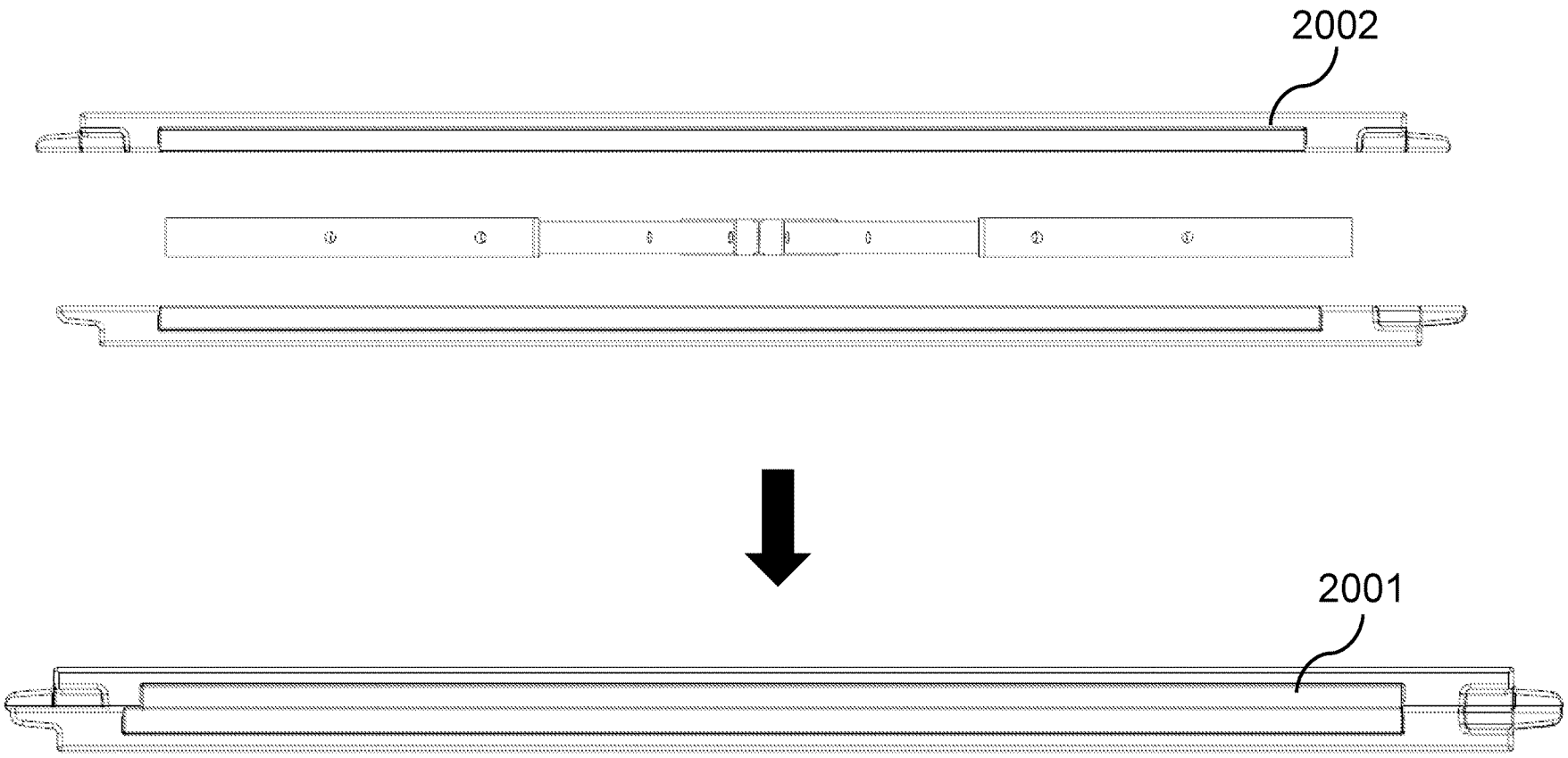
FIG. 22 shows supporting beams and their components, according to an embodiment of the present subject matter.

FIG. 22 shows supporting beams and their components, according to an embodiment of the present subject matter. This drawing shows an exemplary supporting beam 2001 can consist of multiple components of the supporting beam 2001. The components 2002 are shorter and take less space than a completed supporting beam, thus further reducing package space and cost.

Figure 23:
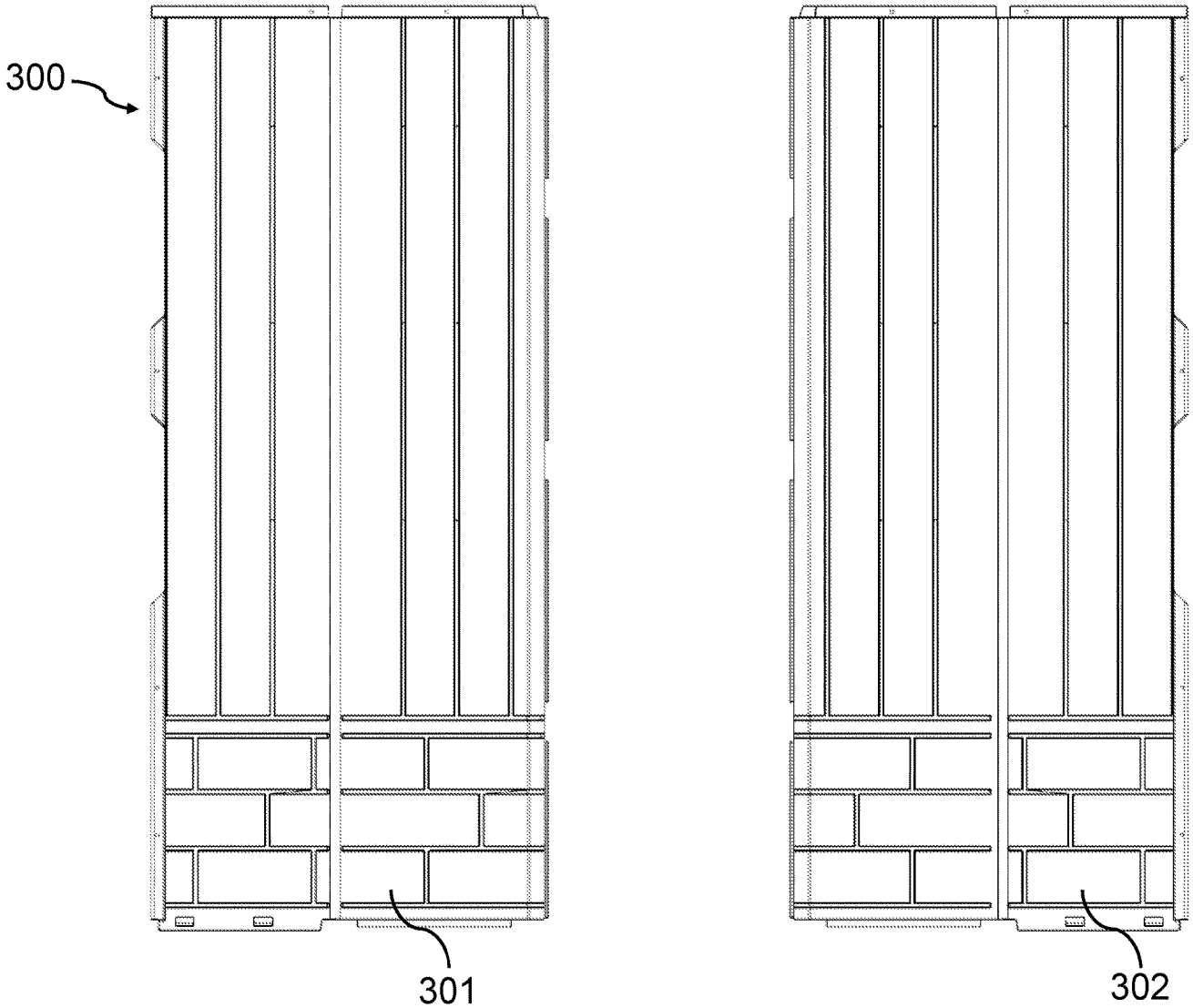
FIG. 23 shows foldable corner panels, according to an embodiment of the present subject matter.

FIG. 23 shows foldable corner panels, according to an embodiment of the present subject matter. According to some embodiments, wall panels can consist of foldable corner panels 300. Examples shown in this drawing include first foldable corner panel 301 for the front right corner of the shed and second foldable corner panel 302 for the left right corner, which constitute mirror images to each other.

Traditionally, the corner assembly of a storage shed consists of two separate panels joined by fasters, leaving a seamed connection that could cause instability. Also, water/rain can enter the shed through the joint/seam and cause damage. The foldable corner panel solves these issues by eliminating the joint between two panels. A foldable corner panel can comprise a folding groove that divides the panel into a first leaf and a second leaf. In addition, each leaf of the foldable panel has a size and shape similar to other wall panels and floor panels. The embedded folding groove can be manufactured by injecting less or thinner plastic material than the rest of the panel, thus rendering a soft area that is flexible and turnable.

During transportation, the two leaves are folded and closed at the groove. Prior to the installation, the foldable molded plastic model can unfold and form a flat surface. During installation, the two leaf panels of the foldable panel can be fixed at a fixed angle, e.g., 90°, to constitute a seamless corner. According to some embodiments, depending on the intended use of the final product, the two leaf panels can form a corner at other angles, such as 60°. According to some embodiments, multiple folding grooves can be integrated into a single panel to create multiple turning areas. Furthermore, the one-piece foldable corner can reduce manufacturing cost and also reduce installation complexity and time for the user.

Figure 24:
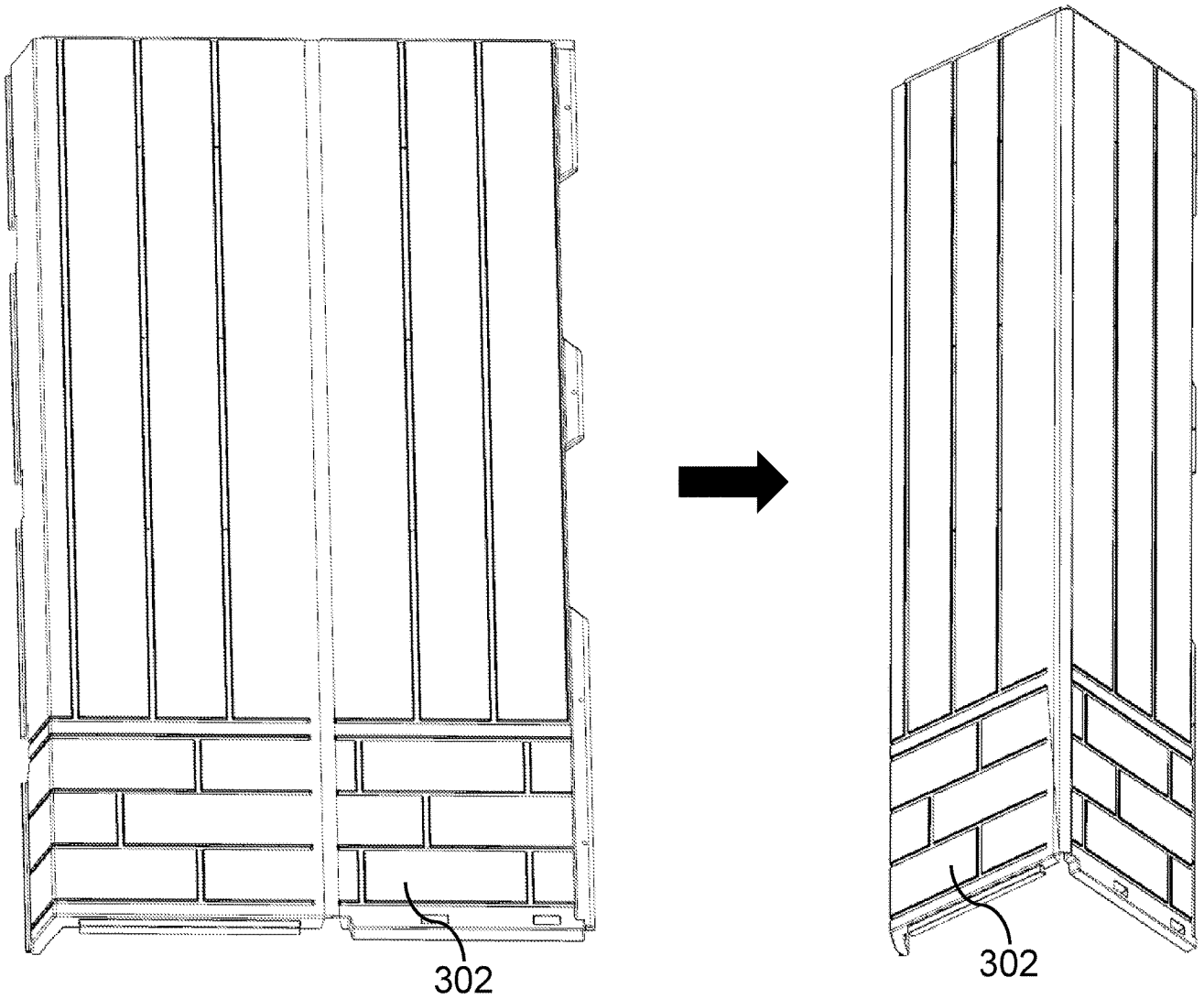
FIG. 24 shows a front view of a foldable corner panel, according to an embodiment of the present subject matter.
Figure 25:
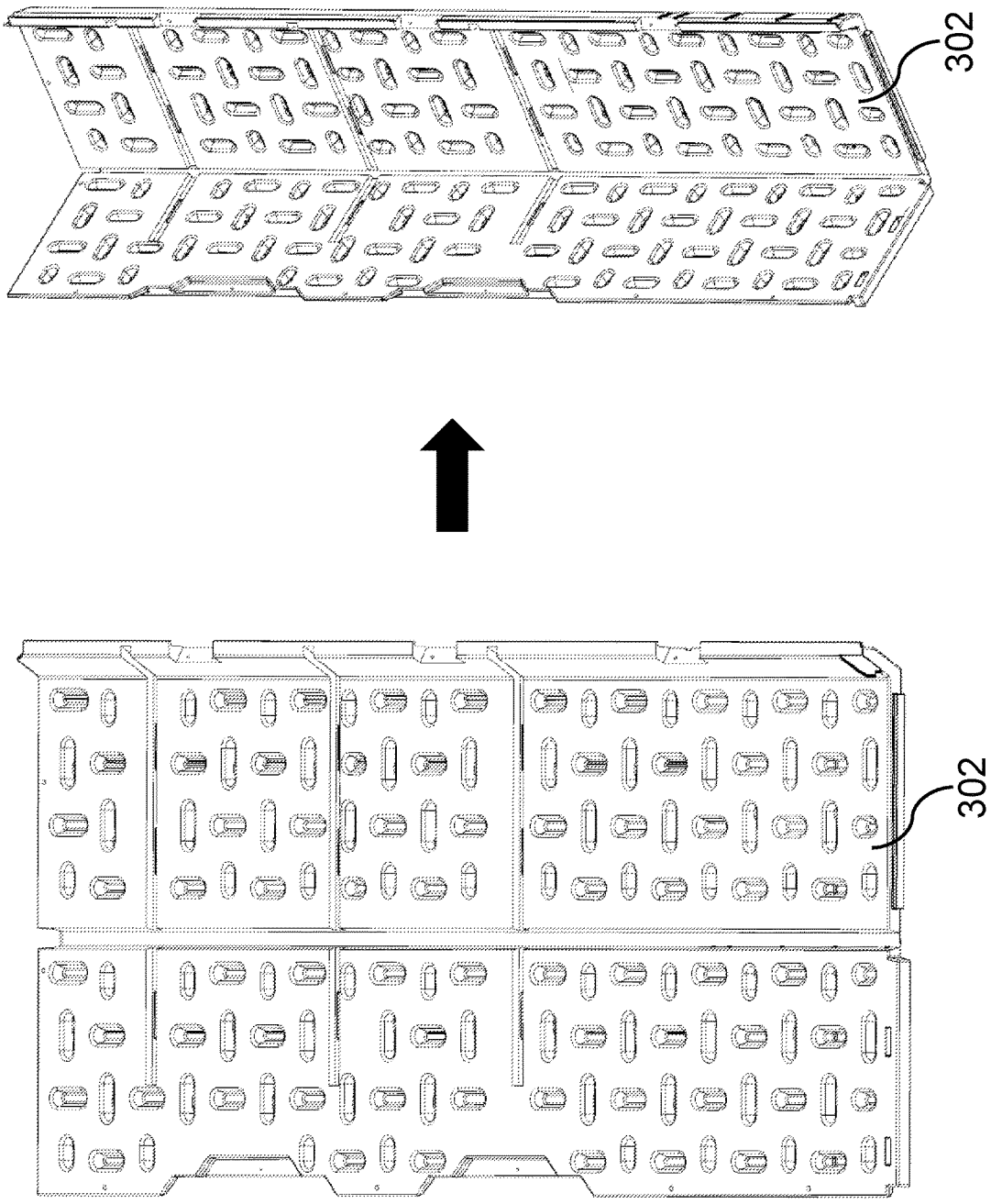
FIG. 25 shows a rear view of a foldable corner panel, according to an embodiment of the present subject matter.

FIG. 24 shows a front view of a foldable corner panel, according to an embodiment of the present subject matter. FIG. 25 shows a rear view of a foldable corner panel, according to an embodiment of the present subject matter. As shown in FIG. 24, a second foldable corner panel 302 can be unfolded at the folding groove and form a flat surface prior to the installation. After the installation, the foldable panel can be affixed to the corner edge floor panels to form a corner. A similar process is shown in FIG. 25 from the rearview.

Figure 26:
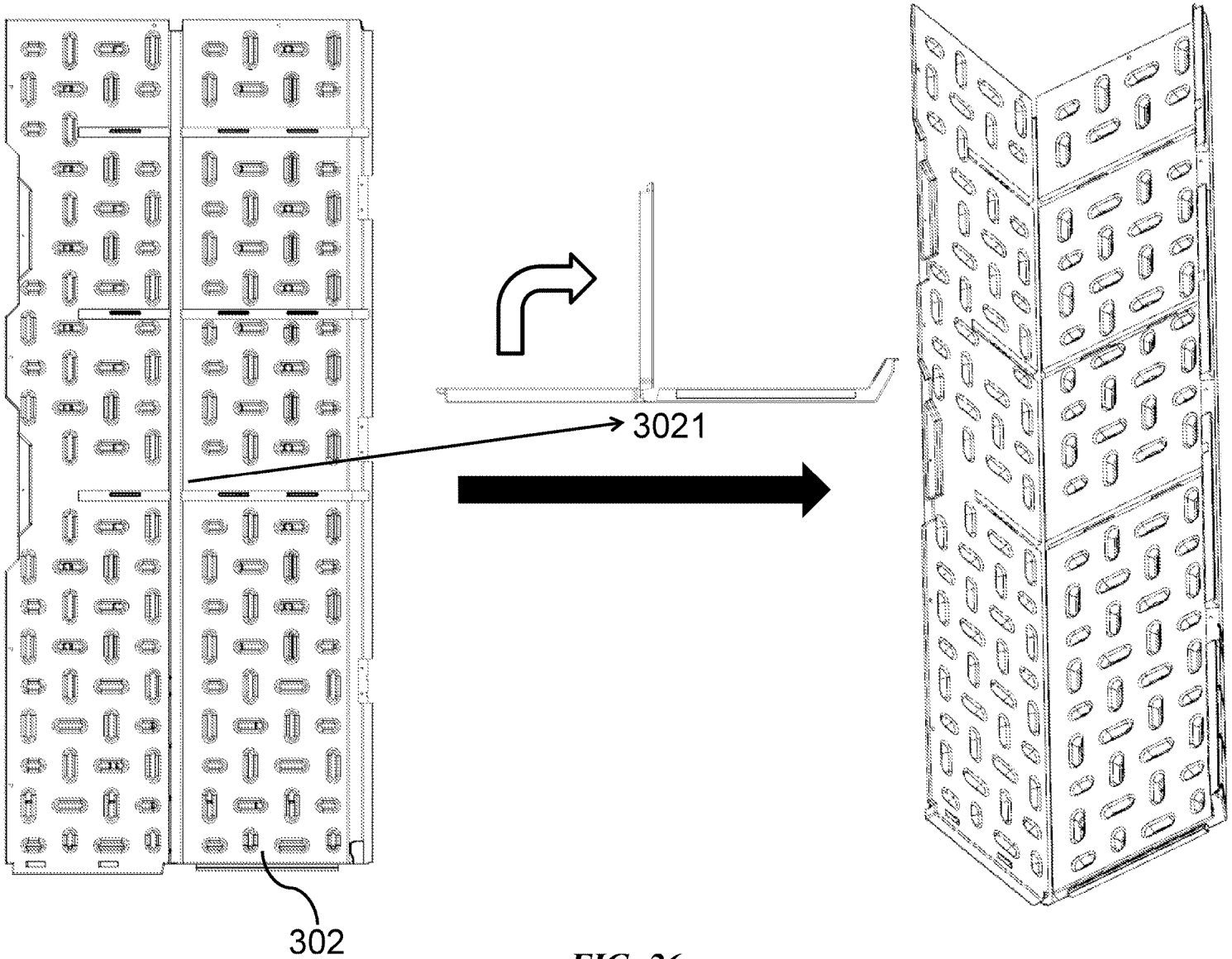
FIG. 26 shows another rear view of a foldable corner panel, according to an embodiment of the present subject matter.

FIG. 26 shows another rear view of a foldable corner panel, according to an embodiment of the present subject matter. As shown in this drawing, a folding groove 3021 can enable the turning of a foldable corner panel, e.g. second foldable corner panel 302.

Figure 27:
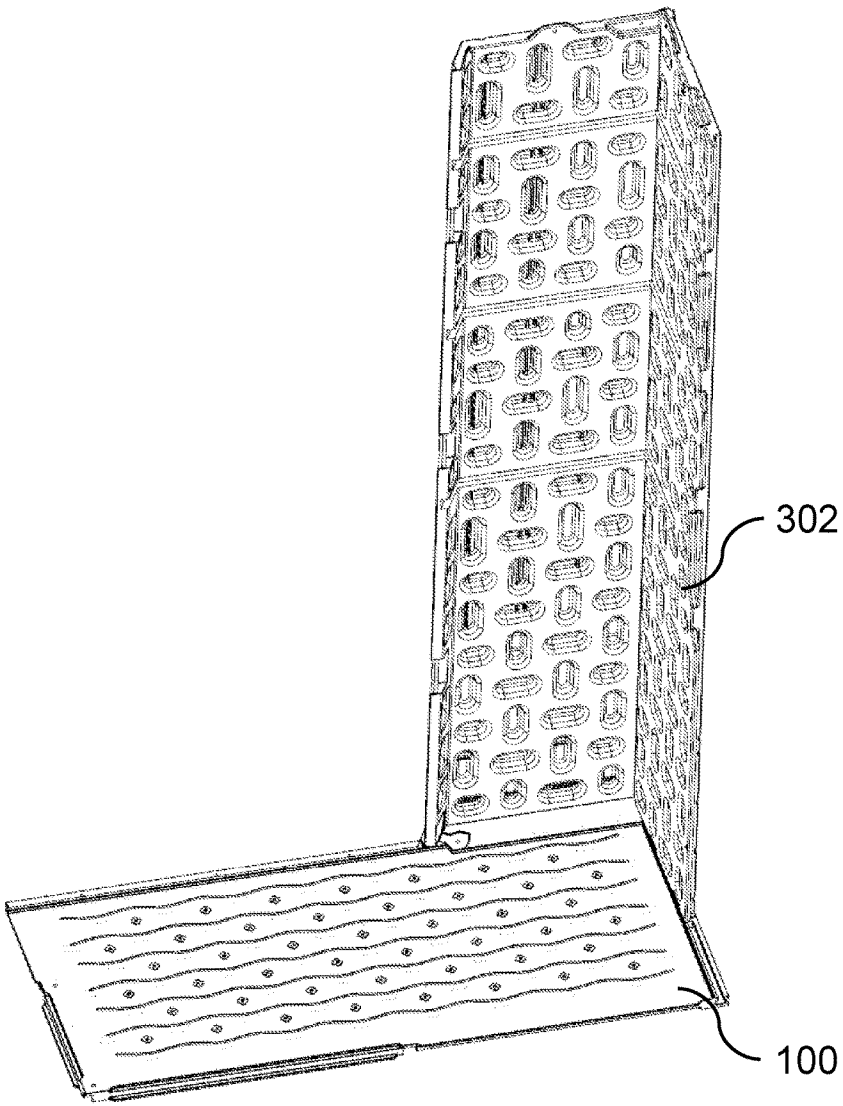
FIG. 27 shows a foldable corner panel coupled to a floor panel, according to an embodiment of the present subject matter.

FIG. 27 shows a foldable corner panel coupled to a floor panel, according to an embodiment of the present subject matter. After installation, second foldable corner panel 302 can be fixed along two edges of floor 100. According to some embodiments, floor 100 can be a corner edge floor panel that comprises two types of coupling mechanisms, e.g., a slider coupling and a clip coupling, on each edged side. According to some embodiments, seam lines between side wall panels can offset with seam lines between floor panels, which means avoiding aligning two seam lines substantially. This way, the connected floor panels and the wall panels can reinforce each other.

Figure 28:
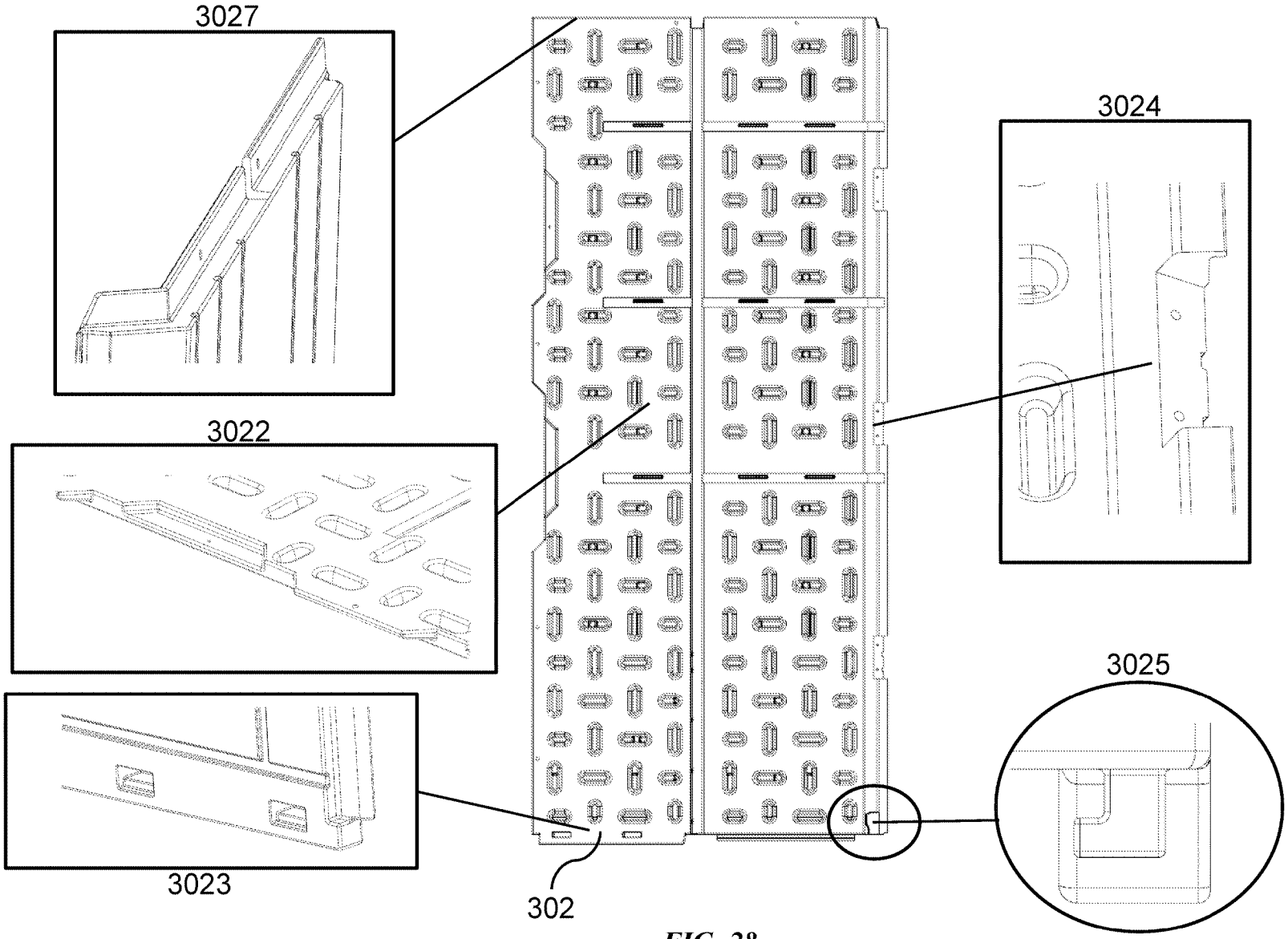
FIG. 28 shows multiple exploded views of foldable corner panel(s), according to an embodiment of the present subject matter.

FIG. 28 shows multiple exploded views of foldable corner panel(s), according to an embodiment of the present subject matter. According to some embodiments, a second foldable corner panel 302 can have a top side 3027 configured to be coupled to a lintel or a roof for the shed. A door hinge slot 3024 can be pre-manufactured so that a door can be connected to the panel. The bottom two sides along the two leaves of the panel 302 can be equipped with one or more coupling mechanisms.

According to some embodiments, each leaf can have a different coupling structure from each other so that the installation is easier, and the structural stability is enhanced. For example, clip slots 3023 on first leaf can be coupled to clips arranged on a floor panel; an L-shaped slider 3025 on a second leaf can be coupled to a L-shaped rail on the floor panel.

In addition, the rear layer of second foldable corner panel 302 can comprise back strengthening ribs 3022. As shown in this drawing, evenly spaced and symmetrically arranged back strengthening ribs are arranged to provide enhanced stability of the plastic panel. According to some embodiments, back strengthening ribs 3022 can comprise vertical support grooves and horizontal support grooves. In particular, each vertical support groove can be surrounded by a plurality of horizontal support grooves. In addition, each horizontal support groove can be surrounded by a plurality of vertical support grooves.

Figure 29:
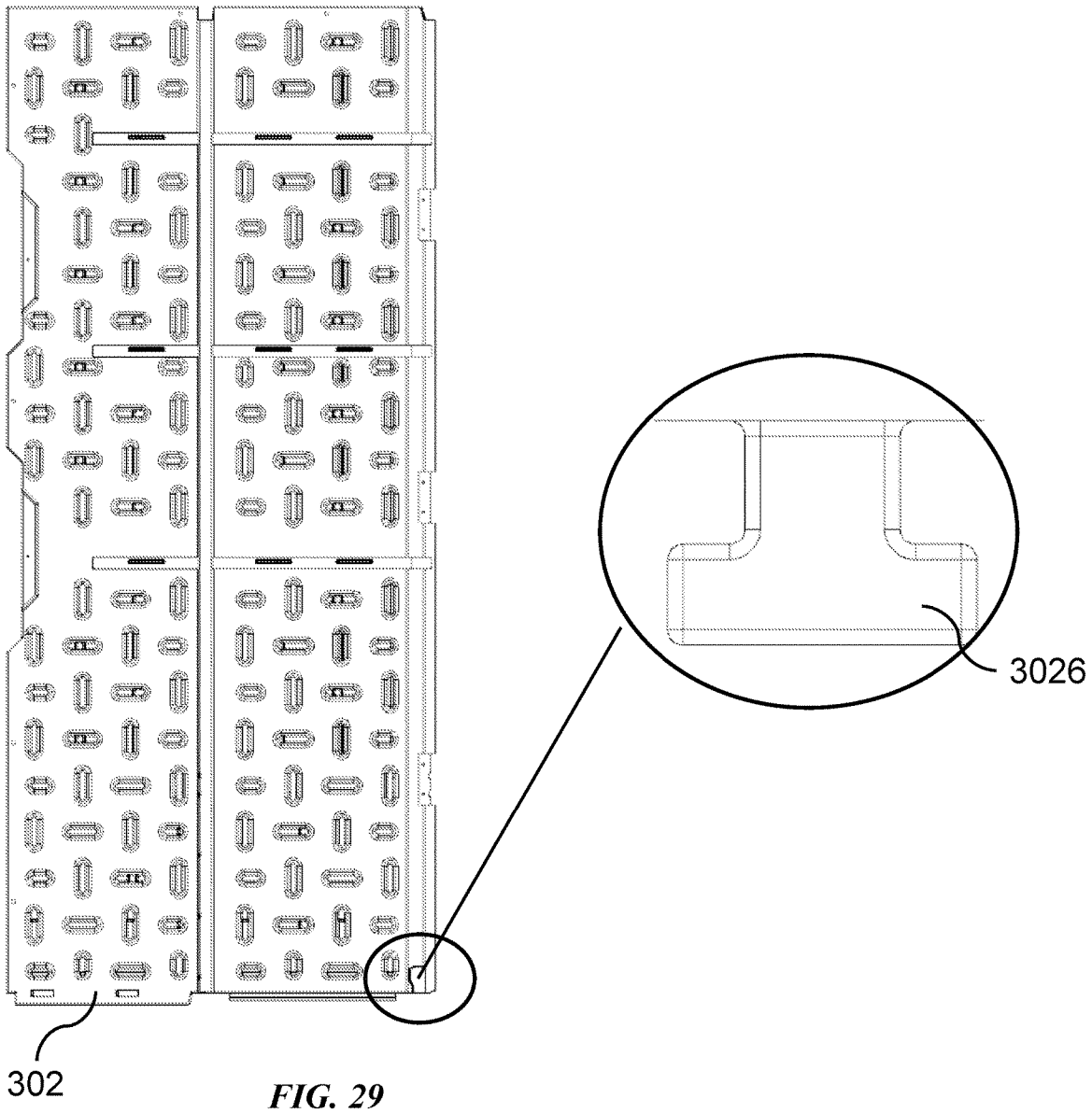
FIG. 29 shows an exploded view of foldable corner panel(s), according to an embodiment of the present subject matter.

FIG. 29 shows an exploded view of foldable corner panel(s), according to an embodiment of the present subject matter. According to some embodiments, second foldable corner panel 302 can have another type of slider, e.g., a T-shaped slider 3026, to engage with a T-shaped rail of a floor panel.

Figure 30:
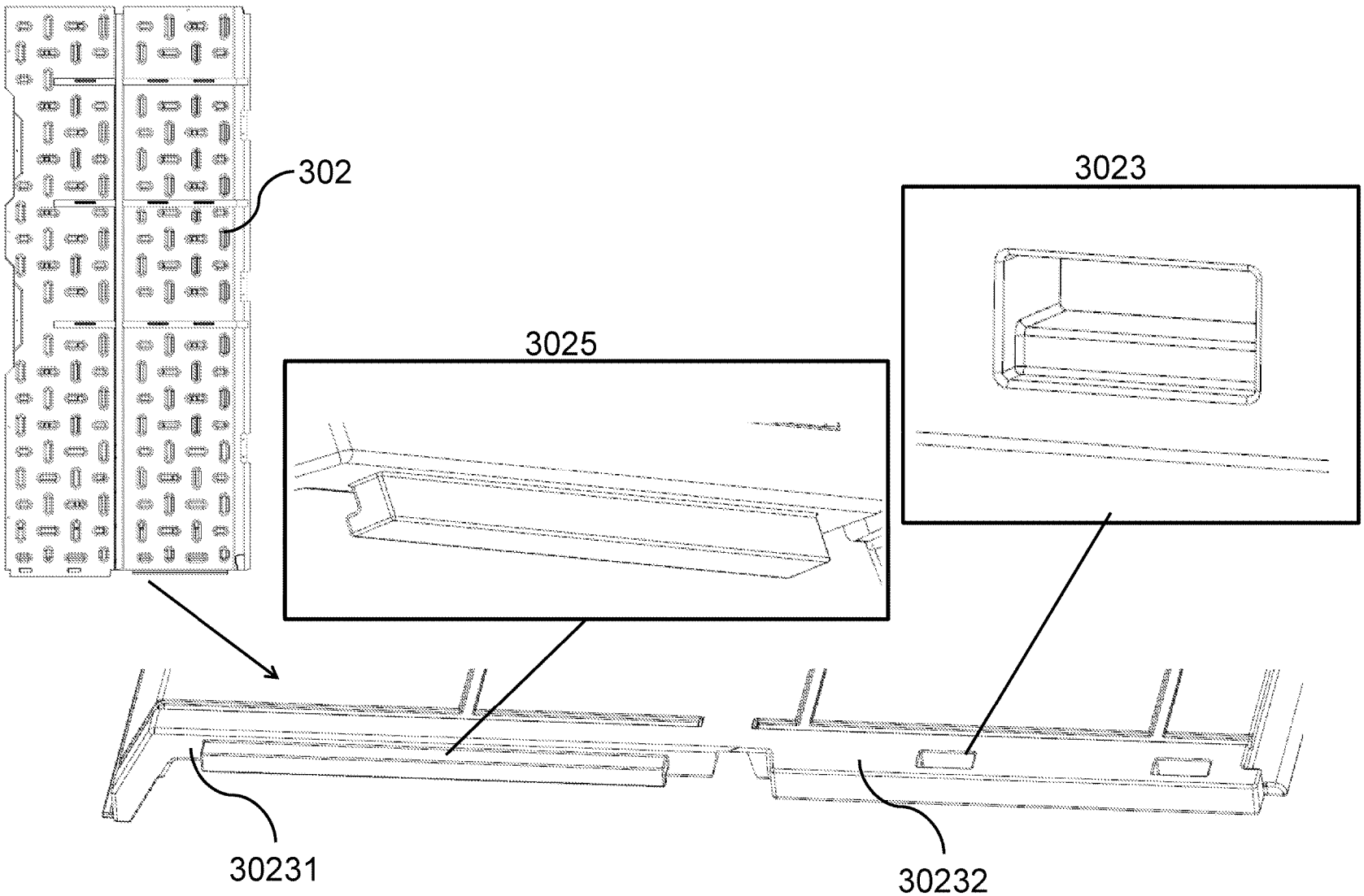
FIG. 30 shows two coupling mechanisms of foldable corner panel(s), according to an embodiment of the present subject matter.

FIG. 30 shows two coupling mechanisms of foldable corner panel(s), according to an embodiment of the present subject matter. According to some embodiments, second foldable corner panel 302 can be divided by an embedded folding groove into a first leaf 30231 and a second leaf 30232. As shown in the exploded views, first leaf 30231 can consist of an L-shaped slider 3025; second leaf 30232 can comprise clip slots 3023. According to some embodiments, the two leaves can incorporate two different coupling mechanisms. The two coupling mechanisms can adopt a contrasting engagement style, i.e. projecting v. receiving, to increase the binding force and stability between the panels. For example, a panel can have a protruding coupling portion, e.g., L-shaped slider 3025, arranged on one leaf, and a receiving coupling portion, e.g., clip slots 3023, arranged on another leaf.

Figure 31:
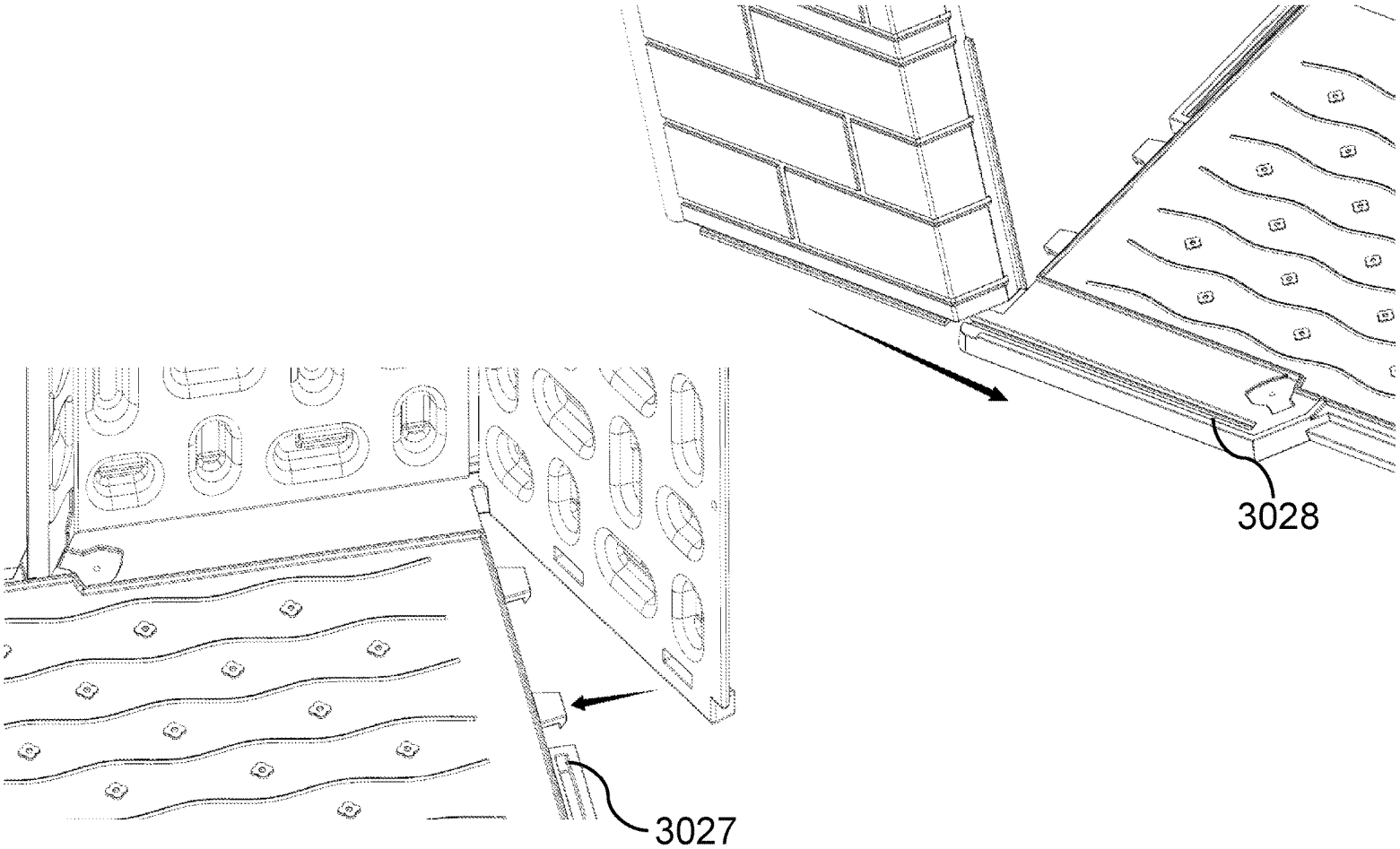
FIG. 31 shows two coupling mechanisms of foldable corner panel(s), according to an embodiment of the present subject matter.

FIG. 31 shows two coupling mechanisms of foldable corner panel(s), according to an embodiment of the present subject matter. As shown in this drawing, a clip coupling structure 3027 is arranged on a first side of the turnable corner panel, whereas a slider coupling structure 3028 is arranged on a second side of the corner panel.

Figure 32:
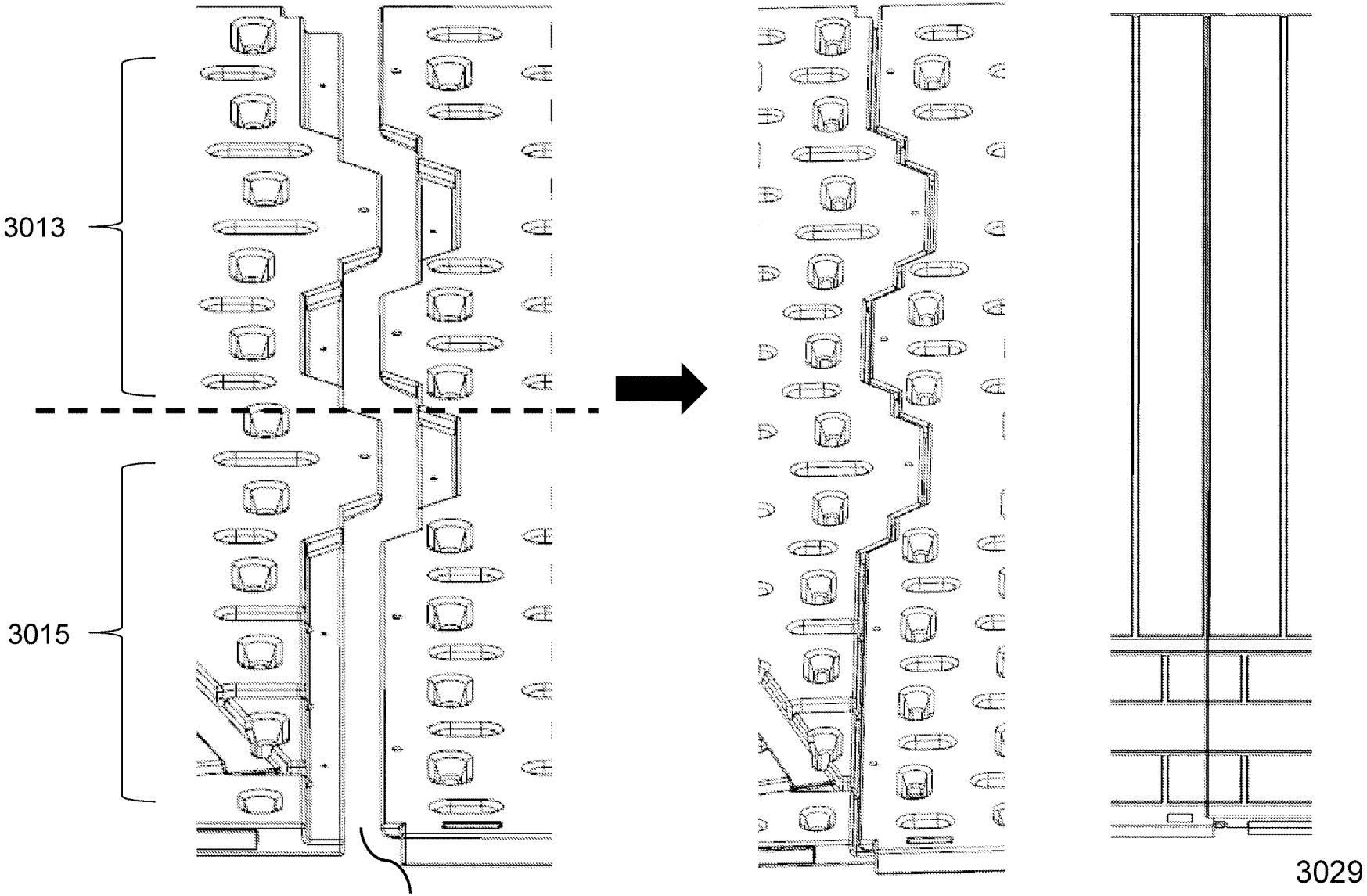
FIG. 32 shows interlocking teeth couplings between two connected wall panels, according to an embodiment of the present subject matter.

FIG. 32 shows interlocking teeth couplings between two connected wall panels, according to an embodiment of the present subject matter. According to some embodiments, interlocked teeth couplings 3011 can comprise a plurality of protrusions/lips on the left wall panel and corresponding recesses arranged on the right wall panel. It is further noted that each protrusion and recess can have varied depths of plastic material, forming varied ledges based on the design and contour of the teeth couplings. Such varied, multi-level engagement can increase the contact surface between the two panels. According to some embodiments, the protrusions/lips and the recesses are distributed asymmetrically along with connecting line. For example, the interlocked teeth portions can be placed closer to or within the upper half region 3013, instead of the lower half region 3015. This way, the installation can take less careful alignment as the lower half region shall be coupled with the floor panels.

One advantage of interlocked teeth couplings 3011 is to increase the binding and unity of any two coupled panels. The increased contact surface resulting from the teeth couplings, protrusions and recesses at varied depths, can share any force applied to the panels, thus improving the stability of the structure. Such couplings can be used between the wall panels, the floor panels, or any other plastic panels. Furthermore, one or more additional fastening tools, such as screws, can be adopted to further secure the connected panels.

FIG. 32 further shows an exterior view 3029 of interlocked teeth couplings 3011. After the assembly, there is a straight seam line formed by the interlocked teeth couplings 3011. Thus, the interlocked teeth couplings can increase the structure stability without sacrificing the aesthetic appeal of the product.

Figure 33:
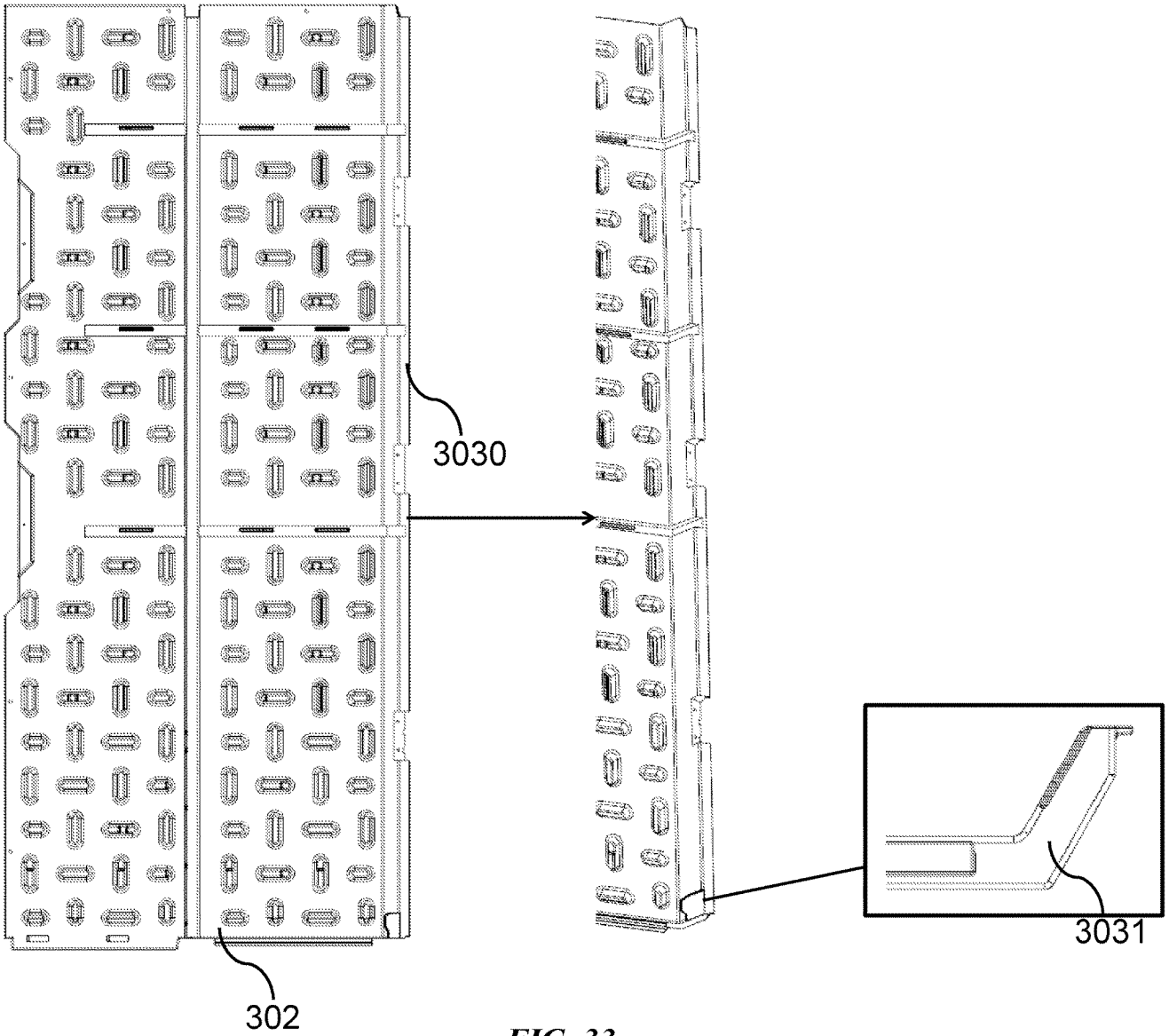
FIG. 33 shows a foldable corner panel with a concave door frame, according to an embodiment of the present subject matter. Traditionally, a shed's door is flush with the wall surface.

FIG. 33 shows a foldable corner panel with a concave door frame, according to an embodiment of the present subject matter. Traditionally, a shed's door is flush with the wall surface. According to some embodiments, the edge of second foldable corner panel 302 can transition into a concave door frame 3030, generating an inwardly concave surface 3031. This concave surface 3031 can be sloped towards a door. As illustrated in the drawing, the concave surface 3031 can be broader than a standard door frame, thus enhancing the stability of the door-wall structure. Moreover, the concave surface 3031 can also serve as a door stopper or brake when the shed door is opened, preventing the door from harshly hitting the wall panels. The design of the concave door frame also can permit the door to recess below the surface of the wall, offering protection to the door from weather elements such as rain, sunlight, or wind.

Figure 34:
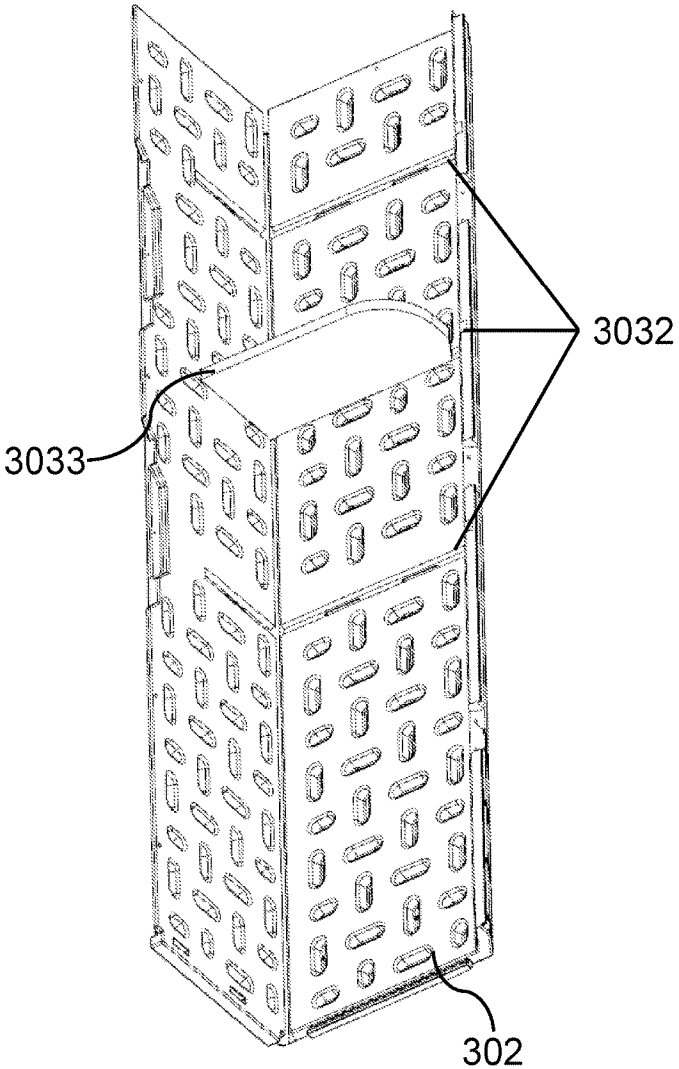
FIG. 34 shows a foldable corner panel with shelf groove(s), according to an embodiment of the present subject matter.

FIG. 34 shows a foldable corner panel with shelf groove(s), according to an embodiment of the present subject matter. According to some embodiments, a foldable corner panel, e.g., second foldable corner panel 302 can consist of a number of shelf grooves 3032 that are manufactured and embedded into the interior surface of the two panel leaves. A number of molded plastic selfs 3033 can be slotted into shelf grooves 3032. Such shelves can offer not only additional storage space within the shed but also increase the structural stability of the corner panel assembly.

Figure 35:
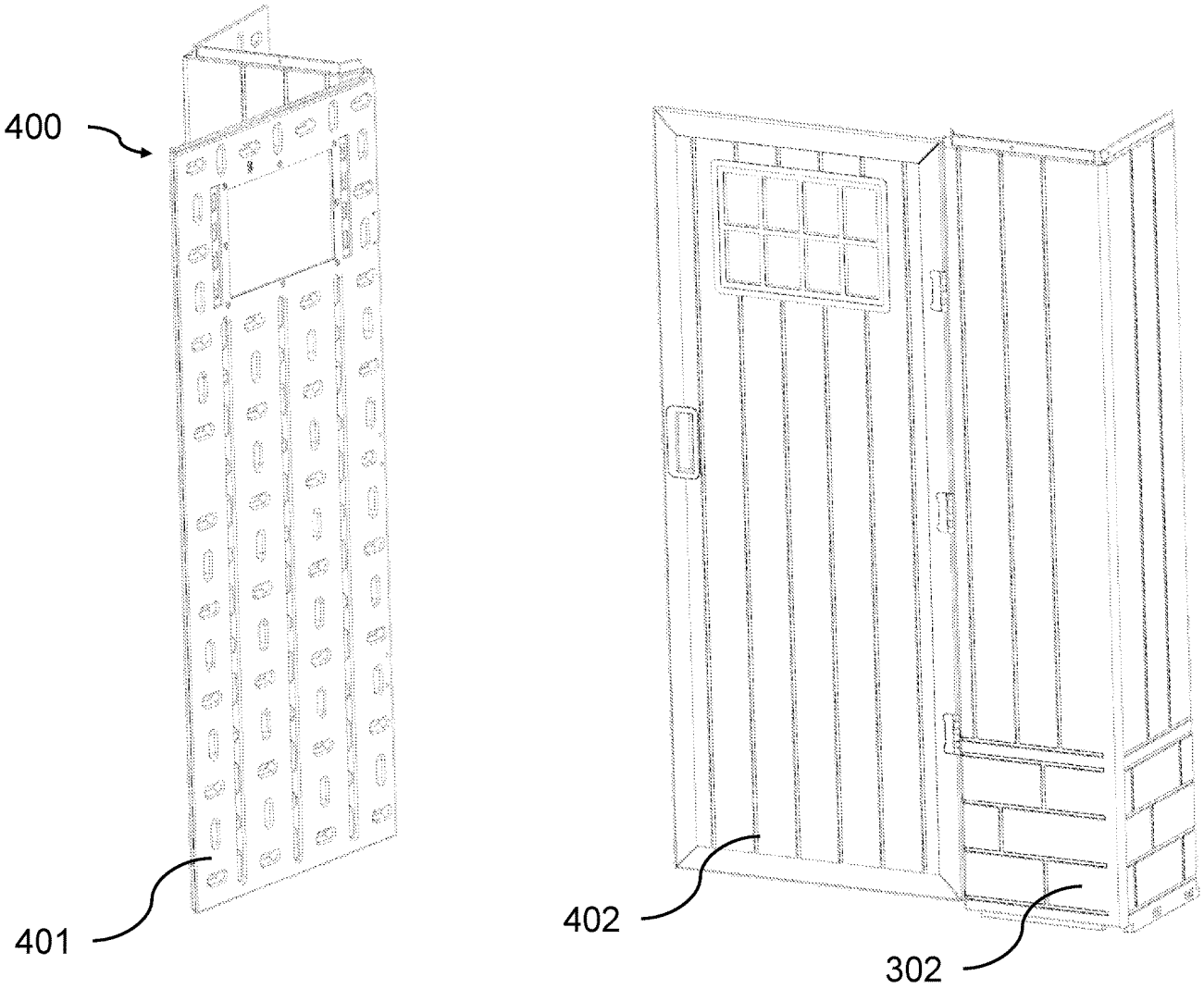
FIG. 35 shows a foldable corner panel coupled with a door, according to an embodiment of the present subject matter.

FIG. 35 shows a foldable corner panel coupled with a door, according to an embodiment of the present subject matter. According to some embodiments, the shed storage structure can comprise a door 400 that further consists of a first door panel 401 and a second door panel 402. Such door 400 can be connected to a foldable corner panel, such as second foldable corner panel 302. According to some embodiments, the shed storage structure can comprise a front door and a back door. According to some embodiments, the shed storage structure can have only a front door.

Figure 36:
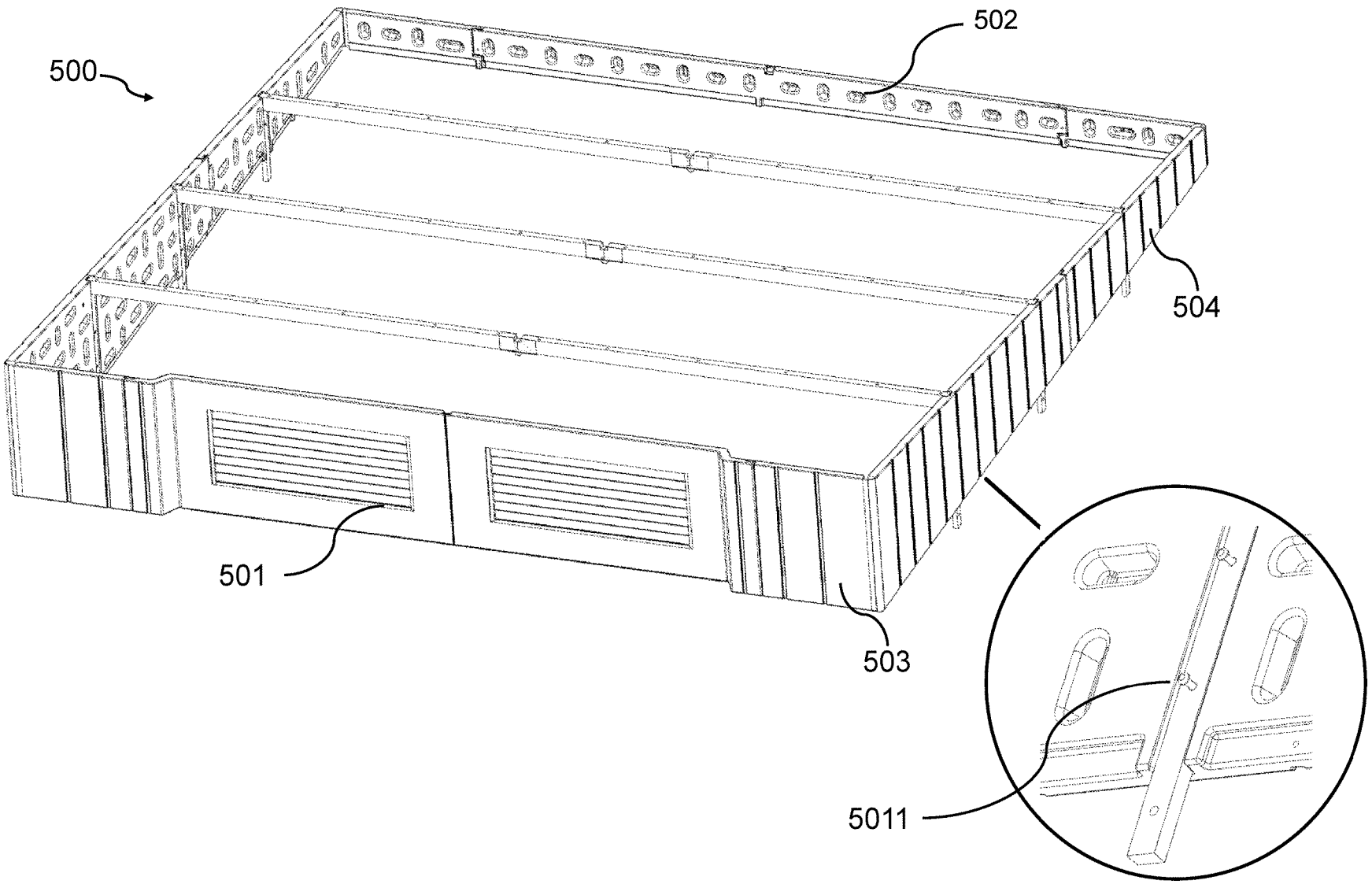
FIG. 36 shows an assembled lintel for the outdoor storage shed, according to an embodiment of the present subject matter.

FIG. 36 shows an assembled lintel for the outdoor storage shed, according to an embodiment of the present subject matter. According to some embodiments, a lintel 500 can function as a supporting component between the shed's wall panels and the roof. Lintel 500 can comprise front lintel 501, rear lintel 502, front foldable lintel panel 503 and rear foldable lintel panel 504. Lintel 500 can be fixed to wall panels and roof via connectors such as screws 5011.

Figure 37:
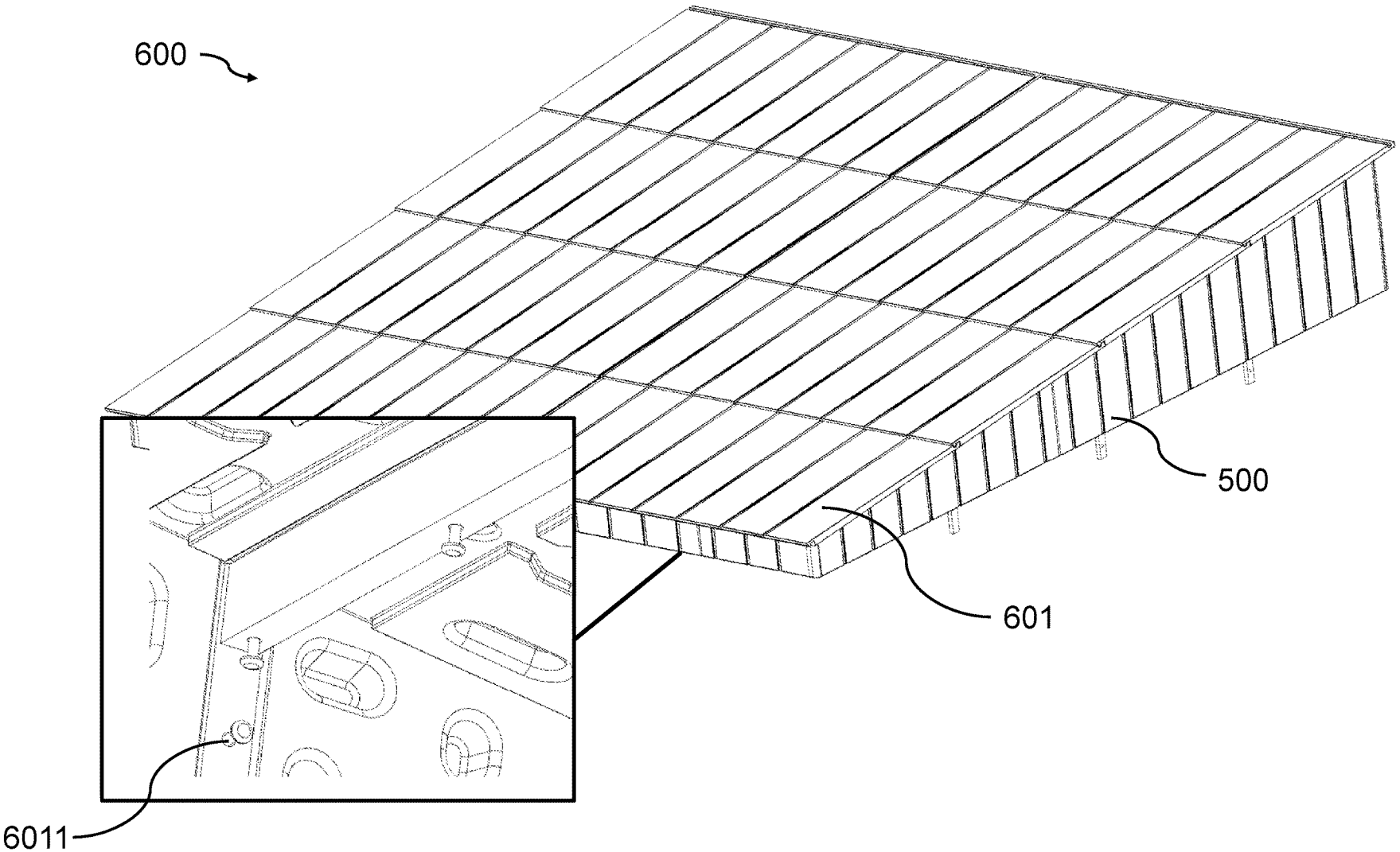
FIG. 37 shows a roof connected with a lintel for the outdoor storage shed, according to an embodiment of the present subject matter.

FIG. 37 shows a roof connected with a lintel for the outdoor storage shed, according to an embodiment of the present subject matter. According to some embodiments, a roof with lintel 600 can comprise a roof 601 that is fixed to lintel 500 via various connectors such as screws 6011.

Figure 38:
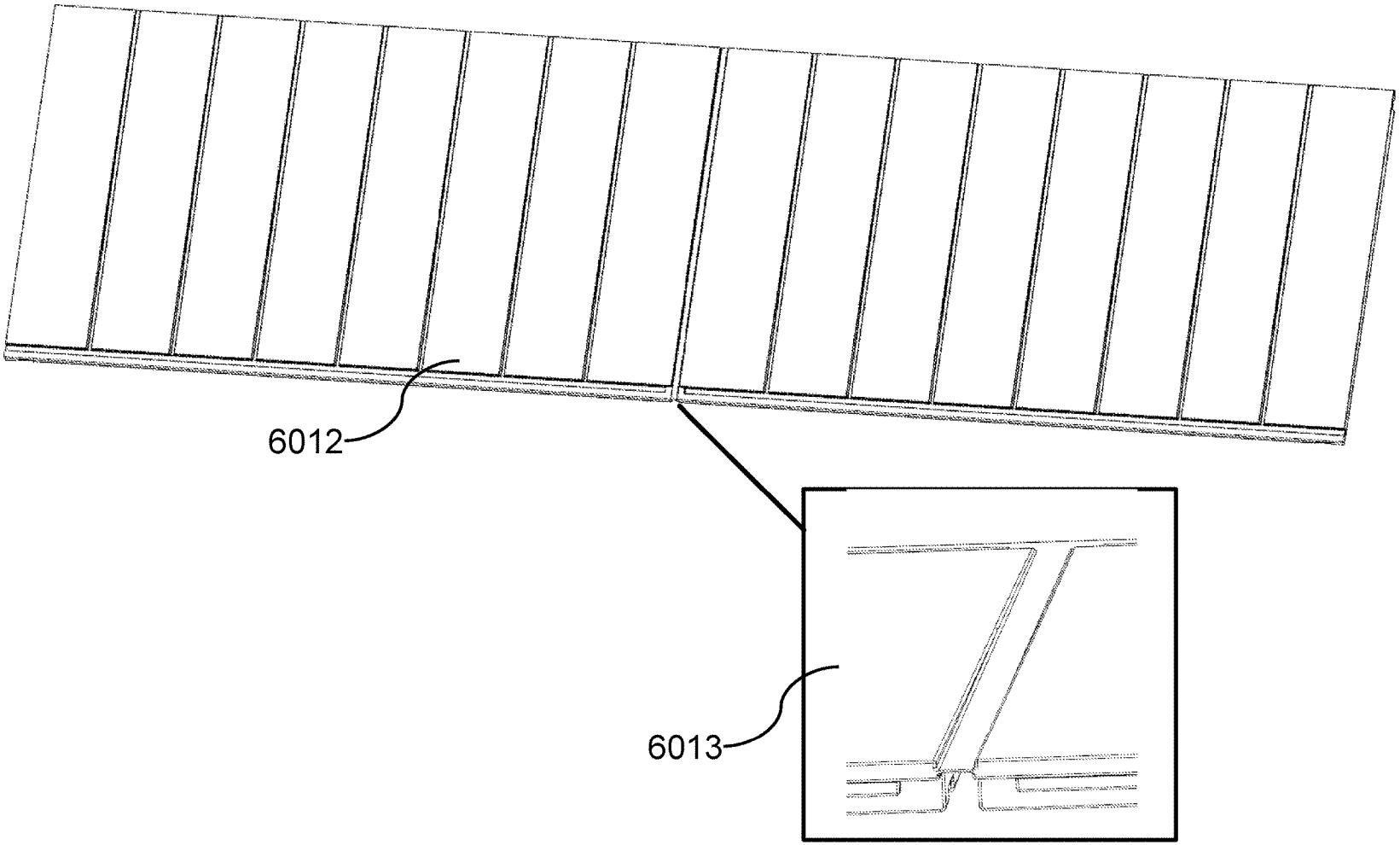
FIG. 38 shows a foldable roof panel for a roof, according to an embodiment of the present subject matter.

FIG. 38 shows a foldable roof panel for a roof, according to an embodiment of the present subject matter. according to some embodiments, a foldable roof panel 6012 can be utilized to reduce the storage space and cost. As shown in the drawing, a folding groove 6013 can be manufactured by injecting less or thinner plastic than the rest of the roof panel. During transportation, foldable roof panel 6012 can be folded into half size at folding groove 6013, which is similar sized with the other panels. During installation, foldable roof panel 6012 can unfold and form a flat surface.

According to some embodiments, the storage shed structure of the present subject matter can be an indoor shed. Furthermore, some or all features of the present subject matter can be incorporated into other types of molded plastic assembly.

The above are only the preferred embodiments of the present subject matter. It should be pointed out that for those of ordinary skill in the art, without departing from the principle of the present subject matter, various modifications or improvements can be made to the present subject matter, such as in other applications. For example, the disclosed features can be incorporated into other molded plastic furniture assemblies, or these features, when applicable, can be incorporated into non-molded plastic furniture assembly, and these are all considered to be within the protection scope of the present subject matter.

It is to be understood that even though numerous characteristics and advantages of various embodiments of the present subject matter have been set forth in the foregoing description, together with details of the structure and function of various embodiments of the subject matter, this disclosure is illustrative only. In some cases, certain subassemblies are only described in detail with one such embodiment. Nevertheless, it is recognized and intended that such subassemblies may be used in other embodiments of the subject matter. Practitioners skilled in the art will recognize many modifications and variations. Changes may be made in detail, especially matters of structure and management of parts within the principles of the embodiments of the present subject matter to the full extent indicated by the broad general meaning of the terms in which the appended claims are expressed.

Having disclosed exemplary embodiments and the best mode, modifications and variations may be made to the disclosed embodiments while remaining within the scope of the embodiments of the subject matter as defined by the following claims.

What is claimed is:

1. A storage shed structure made of molded plastic panels, comprising:

a floor, the floor further comprises:

a plurality of corner edge floor panels; and a plurality of transitional floor panels coupled to the plurality of corner edge floor panels via one or more connectors;

side walls coupled with the floor, the side walls further comprise:

a plurality of flat panels;

a plurality of foldable corner panels that form four corners of the storage shed structure, each foldable corner panel includes an embedded folding groove defined by a living hinge extending an entire length thereof, the embedded folding groove dividing each foldable corner panel into a first leaf and a second leaf;

one or more doors coupled with the side walls and the floor; and a roof that comprises a plurality of foldable roof panels.

2. The storage shed structure of claim 1, wherein the embedded folding groove enables each foldable corner panel to fold at a fixed angle when the storage shed structure is installed.

3. The storage shed structure of claim 1, wherein the molded plastic panels comprise a number of back strengthening ribs that comprise vertical support grooves and horizontal support grooves, and wherein each vertical support groove is surrounded by a plurality of horizontal support grooves.

4. The storage shed structure of claim 1, wherein the plurality of transitional floor panels and the plurality of flat panels of the side walls are extendable.

5. The storage shed structure of claim 1, wherein the embedded folding groove is a first embedded folding groove and further comprising:

a second embedded folding groove positioned within each foldable corner panel.

6. The storage shed structure of claim 1, further comprising:

a number of back strengthening ribs that comprise vertical support grooves and horizontal support grooves, and wherein each vertical support groove is surrounded by a plurality of horizontal support grooves.

7. The storage shed structure of claim 1, wherein the plurality of foldable corner panels are connected to the plurality of flat panels via interlocked teeth couplings.

8. The storage shed structure of claim 7, wherein the interlocked teeth couplings comprise a plurality of protrusions and matched recesses arranged on both the plurality of foldable corner panels and the plurality of flat panels, wherein each of the corner panels and flat panels has a varied depth based on a design of the interlocked teeth couplings.

9. The storage shed structure of claim 1, further comprising:

a first coupling structure arranged on the first leaf;

a second coupling structure arranged on the second leaf, wherein the first coupling structure is different from the second coupling structure.

10. The storage shed structure of claim 9, wherein the first coupling structure comprises a slider and the second coupling structure comprises one or more clip slots.

11. The storage shed structure of claim 1, further comprising:

a plurality of shelf grooves embedded into interior surfaces of a respective foldable panel.

12. The storage shed structure of claim 11, further comprising:

one or more shelves configured to insert into the plurality of shelf grooves to provide storage and to enhance stability of the storage shed structure.

13. The storage shed structure of claim 1, wherein each corner edge floor panel has two sides to connect to wall panels and each transitional floor panel has one side to connect to the wall panels.

14. The storage shed structure of claim 13, wherein at least one side of the corner edge floor has more than one coupling mechanism.

15. The storage shed structure of claim 13, wherein a first side of a respective said transitional floor panel has a first slider rail, a first side of a respective said corner edge floor panel has a second slider rail configured to be in continuation with the first slider rail, and wherein the first side of the corner edge floor panel further has one or more clips.

16. The storage shed structure of claim 13, wherein the first slider rail of the respective transitional floor panel and the second slider rail of the respective corner edge floor panel are configured to engage with a first slider of a wall panel, and wherein the one or more clips of the respective corner edge floor panel are configured to engage one or more clip slots on the wall panel.

17. A storage shed structure made of molded plastic panels, comprising:

a floor, the floor further comprises:

a plurality of corner edge floor panels; and a plurality of transitional floor panels coupled to the plurality of corner edge floor panels via one or more connectors;

side walls coupled with the floor, the side walls further comprise:

a plurality of flat panels;

a plurality of foldable corner panels that form four corners of the storage shed structure, each foldable corner panel includes an embedded folding groove defined by a living hinge extending an entire length thereof, the embedded folding groove dividing each foldable corner panel into a first leaf and a second leaf;

a plurality of shelf grooves embedded into interior surfaces of the corner panels; and one or more shelves configured to insert into the plurality of shelf grooves to provide storage and to enhance stability of the storage shed structure;

one or more doors coupled with the side walls and the floor; and a roof that comprises a plurality of foldable roof panels.

18. The storage shed structure of claim 17, further comprising:

a number of back strengthening ribs that comprise vertical support grooves and horizontal support grooves, and wherein each vertical support groove is surrounded by a plurality of horizontal support grooves.

19. The storage shed structure of claim 17, wherein the plurality of transitional floor panels and the plurality of flat panels of the side walls are extendable.

* * * * *